United States Patent [19]

Mihayashi et al.

[11] Patent Number: 4,904,579

[45] Date of Patent: Feb. 27, 1990

[54] SILVER HALIDE COLOR PHOTOGAPHIC MATERIAL

[75] Inventors: Keiji Mihayashi; Hidetoshi Kobayashi, both of Kanagawa, Japan

[73] Assignee: Fuji Photo Film Co., Ltd., Kanagawa, Japan

[21] Appl. No.: 114,320

[22] Filed: Oct. 29, 1987

[30] Foreign Application Priority Data

Oct. 29, 1986 [JP] Japan ..... 61-257970

[51] Int. Cl.[4] ..... G03C 7/38; G03C 7/26

[52] U.S. Cl. ..... 430/551; 430/546; 430/548; 430/555

[58] Field of Search ..... 430/551, 548, 555, 546, 430/544

[56] References Cited

U.S. PATENT DOCUMENTS

| | | | |
|---|---|---|---|
| 4,252,893 | 2/1981 | Iwamuro | 430/551 |
| 4,297,438 | 10/1981 | Haseler et al. | 430/377 |
| 4,383,027 | 5/1983 | Ishikawa et al. | 430/555 |
| 4,436,808 | 3/1984 | Yagihara et al. | 430/548 |
| 4,455,363 | 6/1984 | Naito et al. | 430/548 |
| 4,464,464 | 8/1984 | Matejec et al. | 430/546 |
| 4,491,630 | 1/1985 | Ishikawa et al. | 430/555 |
| 4,745,050 | 5/1988 | Seto et al. | 430/555 |
| 4,820,623 | 4/1989 | Koshimizu et al. | 430/555 |
| 4,840,877 | 6/1989 | Abe et al. | 430/372 |

FOREIGN PATENT DOCUMENTS

| | | | |
|---|---|---|---|
| 000956 | 1/1987 | Japan | 430/555 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A light-sensitive silver halide color photographic material comprising a support having thereon at least one silver halide emulsion layer, wherein the silver halide color photographic material comprises at least one layer containing a 5-pyrazolone magenta coupler represented by general formula (I) and a non-color forming, diffusion-resistant carboxylic acid compound:

(I)

wherein W represents an aryl group; Y represents a carbonamido group, a ureido group or an anilino group; and R represents an alkyl group, an aryl group or a heterocyclic group.

The silver halide color photographic material has high sensitivity, high color forming property, good formalin resistivity and good preservability, and provides magenta color images having good stability.

19 Claims, No Drawings

SILVER HALIDE COLOR PHOTOGAPHIC MATERIAL

FIELD OF THE INVENTION

The present invention relates to a silver halide color photographic material, and more particularly to a silver halide color photographic material having high sensitivity, high color forming properties, good formalin resistivity and good preservability before development, and which provides magenta color images having good stability upon development.

BACKGROUND OF THE INVENTION

It iw well known that after a silver halide photographic light-sensitive material is exposed to light, an oxidized aromatic primary amine developing agent reacts with a dye forming coupler to form color images. In this type of process, color reproduction by a conventional substractive process is used to form color images composed of cyan, magenta, and yellow dyes, which are the complementary colors of red, green, and blue, respectively. The reaction of the coupler with the oxidation product of the color developing agent is carried out at a coupling active site. A coupler having a hydrogen atom as a substituent at the active site is known as a 4-equivalent coupler, i.e., a coupler which stoichiometrically requires 4 mols of silver halide having a development nucleus as an oxidizing agent for forming 1 mol of dye.

On the other hand, a coupler having a group releasable as an anion as a substituent at the active site is known as a 2-equivalent coupler, i.e., a coupler which requires only 2 mols of silver halide having a development nucleus for forming 1 mol of dye. Accordingly, the processing time for photographic light-sensitive materials can be shortened, and the sharpness of the color images formed can be improved when a 2-equivalent coupler is used, as compared with using a 4-equivalent coupler, because it is possible to reduce the amount of silver halide in the light-sensitive layer of the photographic material and thus reduce the thickness of the layer. Further, in 2-equivalent couplers, it is possible to change the coupling activity with respect to the color developing agent by changing the properties of the releasing group.

Several attempts have been made for the purpose of preparing 2-equivalent couplers from 5-pyrazolone type couplers which are employed very often in practice. For instance, the 4-position of the pyrazolone ring can be substituted with a thiocyano group as described in U.S. Pat. Nos. 3,214,437 and 3,253,924, an aryloxy group as described in U.S. Pat. No. 3,419,391, a 2-triazolyl group as described in U.S. Pat. No. 3,617,291, or a halogen atom as described in U.S. Pat. No. 3,522,052.

However, these 4-position substituted pyrazolone couplers have several disadvantages in that they cause the formation of severe color fog, in that they have a relatively low coupling activity, in that they are chemically unstable per se and liable to convert into compounds which are unable to form color with the lapse of time and in that they are difficult to synthesize, etc.

Further, U.S. Pat. Nos. 3,227,554, 4,366,237 and 4,522,915, etc. describe that the 4-position of pyrazolone may be substituted with an alkylthio group, an arylthio group or a heterocyclic thio group. However, these couplers are also disadvantageous since they also have a relatively low coupling activity, or their properties are liable to deteriorate in photographic light-sensitive materials during preservation, etc.

On the other hand, in U.S. Pat. No. 3,700,454, it is described that an alkyl-substituted phenoxyalkyl carboxylic acid is employed as a solvent component for a coupler having an alkyl-substituted phenoxyalkanamido group as a diffusion resistant group. However, there is no description relating to the magenta couplers used in the present invention in this patent. Further, in the present invention it is not necessary that the coupler comprise the alkyl-substituted phenoxyalkanamido group as described in the above-described patent and that the carboxylic acid compound is the alkyl-substituted phenoxyalkyl carboxylic acid.

Moreover, improvements in color forming property and graininess achieved by a carboxylic acid type compound having an ester group are described in U.S. Pat. No. 4,464,464. However, the remarkable effects according to the present invention are peculiarly exhibited only when these (or other) carboxylic acid type compounds are used in combination with the magenta couplers according to the present invention. Further, carboxylic acid compounds outside the scope of the above-noted U.S. patent are also effective in the present invention.

SUMMARY OF THE INVENTION

An object of the present invention, therefore, is to provide a light-sensitive silver halide color photographic material (hereinafter referred to as a color light-sensitive material) which has an improved color forming property of magenta coupler and which provides high sensitivity.

Another object of the present invention is to provide a color light-sensitive material having excellent stability during preservation before development processing.

A further object of the present invention is to provide a color light-sensitive material which provides a color image having stable image density after development processing.

A still further object of the present invention is to provide a color light-sensitive material which is excellent in formalin resistivity.

Yet another object of the present invention is to provide a color light-sensitive material which provides high color density even when subjected to development processing comprising a color development step without using benzyl alcohol, and when subjected to development processing capable of being completed in a short period of time.

Other objects of the present invention will become apparent from the following detailed description of the invention and examples.

The above and other objects of present invention are accomplished with a light-sensitive silver halide color photographic material comprising a support having thereon at least one silver halide emulsion layer, wherein the silver halide color photographic material comprises at least one layer containing a 5-pyrazolone magenta coupler represented by general formula (I) described below and a non-color forming, diffusion-resistant carboxylic acid compound:

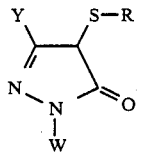

(I)

wherein W represents an aryl group; Y represents a carbonamido group, a ureido group or an anilino group; and R represents an alkyl group, an aryl group or a heterocyclic group.

DETAILED DESCRIPTION OF THE INVENTION

The 5-pyrazolone magenta couplers represented by general formula (I) are described in detail below. In general formula (I), W represents a substituted or unsubstituted aryl group. Examples of suitable substituents for the aryl group include a halogen atom, a cyano group, a nitro group, a carboxyl group, a sulfo group, an alkyl group, an alkoxy group, an alkoxycarbonyl group, a carbamoyl group, a sulfamoyl group, a ureido group, an alkoxycarbonylamino group, a sulfamoylamino group, a carbonamido group, and a sulfonamido group, etc. W is preferably an aryl group substituted with at least one of a halogen atom, an alkyl group, an alkoxy group, an alkoxycarbonyl group or a cyano group.

W in general formula (I) preferably represents a substituted phenyl group. Suitable examples of the substituents for the phenyl group include a halogen atom (for example, a chlorine atom, a bromine atom, a fluorine atom, etc.), an alkyl group having from 1 to 22 carbon atoms (for example, a methyl group, an ethyl group, a tetradecyl group, a tert-butyl group, etc.), an alkoxy group having from 1 to 22 carbon atoms (for example, a methoxy group, an ethoxy group, an octyloxy group, a dodecyloxy group, etc.), an alkoxycarbonyl group having from 2 to 23 carbon atoms (for example, a methoxycarbonyl group, an ethoxycarbonyl group, a tetradecyloxycarbonyl group, etc.), or a cyano group.

In general formula (I), Y suitably represents a carbonamido group having from 1 to 48 carbon atoms, a ureido group having from 1 to 36 carbon atoms or an anilino group having from 6 to 48 carbon atoms. Of these, a carbonamido group and an anilino group are preferred.

Y may be substituted. Suitable examples of the substituents for the Y include a halogen atom (for example, a fluorine atom, a chlorine atom, a bromine atom, etc.), an alkyl group (for example, a methyl group, a tert-octyl group, a dodecyl group, trifluoromethyl group, etc.), an alkenyl group (for example, an allyl group, an octadecenyl group, etc.), an aryl group (for example, a phenyl group, a p-tolyl group, a naphthyl group, etc.), an alkoxy group (for example, a methoxy group, a benzyloxy group, a methoxyethoxy group, etc.), an aryloxy group (for example, a phenoxy group, a 2,4-di-tert-amylphenoxy group, a 3-tert-butyl-4-hydroxyphenoxy group, etc.), an acyl group (for example, an acetyl group, a benzoyl group, etc.), a sulfonyl group (for example, a methanesulfonyl group, a toluenesulfonyl group, etc.), a carboxyl group, a sulfo group, a cyano group, a hydroxyl group, an amino group (for example, an amino group, a dimethylamino group, etc.), a carbonamido group (for example, an acetamido group, a trifluoroacetamido group, a tetradecaneamido group, a benzamido group, etc.), a sulfonamido group (for example, a methanesulfonamido group, a hexadecanesulfonamido group, a p-toluenesulfonamido group, etc.), an acyloxy group (for example, an acetoxy group, etc.), a sulfonyloxy group (for example, a methanesulfonyloxy group, etc.), an alkoxycarbonyl group (for example, a dodecyloxycarbonyl group, etc.), an aryloxycarbonyl group (for example, a phenoxycarbonyl group, etc.), a carbamoyl group (for example, a dimethylcarbamoyl group, a tetradecylcarbamoyl group, etc.), a sulfamoyl group (for example, a methylsulfamoyl group, a hexadecylsulfamoyl group, etc.), an imido group (for example, a succinimido group, a phthalimido group, an octadecenylsuccinimido group, etc.), a heterocylic group (for example, a 2-pyridyl group, a furyl group, a 2-thienyl group, etc.), an alkylthio group (for example, a methylthio group, etc.) and an arylthio group (for example, a phenylthio group, etc.).

In general formula (I), R suitably represents an alkyl group having from 1 to 36 carbon atoms (for example, a methyl group, a benzyl group, a dodecyl group, a hexadecyl group, a carboxymethyl group, a carboxyethyl group, a dodecyloxyethyl group, etc.), a heterocyclic group having from 1 to 36 carbon atoms (for example, a 2-pyridyl group, a 4-pyridyl group, a 5-carboxymethylthio-1,3,4-thiadiazol-2-yl group, a 1-carboxyethyl-1,2,3,4-tetrazol-5-yl group, a 1-carboxypropyl-1,2,3,4-tetrazol-5-yl group, etc.) or an aryl group having from 6 to 36 carbon atoms which will be described in greater detail below. Of these, an aryl group is preferred.

Of the 5-pyrazolone magenta couplers represented by general formula (I), preferred compounds are represented by the following general formula (II):

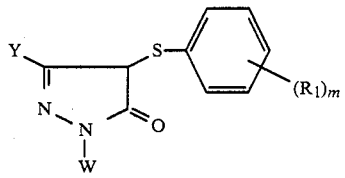

(II)

wherein W and Y each has the same meaning as defined in general formula (I); $R_1$ represents a hydrogen atom, a halogen atom, a carbonamido group, a sulfonamido group, a carbamoyl group, a sulfamoyl group, an alkylthio group, an alkoxycarbonyl group, a hydroxyl group, an alkyl group, an alkoxy group or an aryl group; and m represents an integer of from 1 to 5, and when m is 2 or more, $R_1$'s may be the same or different.

Of the 5-pyrazolone magenta couplers represented by general formula (II), more preferred compounds are represented by the following general formula (III):

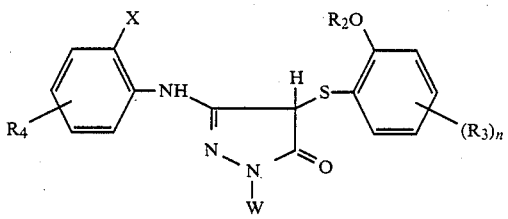

(III)

wherein W has the same meaning as defined in general formula (II); $R_2$ represents an alkyl group or an aryl group; X represents a halogen atom or an alkoxy group; $R_3$ represents a hydrogen atom, a hydroxyl group, a halogen atom, an alkyl group, an alkoxy group or an aryl group; $R_4$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxyl group, or a trichloromethyl group; and n represents an integer of from 1 to 4.

More particularly, X represents a halogen atom (for example, a chlorine atom, a bromine atom, a fluorine atom, etc.) or an alkoxy group having from 1 to 22 carbon atoms (for example, a methoxy group, an octyloxy group, a dodecyloxy group, etc.).

$R_4$ more particularly represents a hydrogen atom, a halogen atom (for example, a chlorine atom, a bromine atom, a fluorine atom, etc.), a straight chain or branched chain alkyl group (for example, a methyl group, a tert-butyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, a tetradecanamido group, an α-(2,4-di-tert-amylphenoxy)acetamido group, an α-(2,4-di-tert-amylphenoxy)-butyramido group, an α-(3-pentadecylphenoxy)hexanamido group, an α-(4-hydroxy-3-tert-butylphenoxy)-tetradecanamido group, a 2-oxopyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (for example, an N-methylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (for example, an N-methylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, an octyloxysulfonyl group, a tetradecyloxysulfonyl group, etc.), an aryloxysulfonyl group (for example, a phenoxysulfonyl group, a 2,4-di-tert-amylphenoxysulfonyl group, etc.), an alkanesulfonyl group (for example, a methanesulfonyl group, an octanesulfonyl group, a 2-ethylhexanesulfonyl group, a hexadecanesulfonyl group, etc.), an arylsulfonyl group (for example, a benzenesulfonyl group, a 4-nonylbenzenesulfonyl group, etc.), an alkylthio group (for example, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, an ethyloxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group or a trichloromethyl group. In the above-described substituents, the alkyl moieties thereof preferably have from 1 to 36 carbon atoms, and the aryl moieties thereof preferably have from 6 to 38 carbon atoms.

$R_2$ more specifically represents an alkyl group having from 1 to 22 carbon atoms (for example, a methyl group, a propyl group, a butyl group, a 2-methoxyethyl group, a methoxymethyl group, a hexyl group, a 2-ethylhexyl group, a dodecyl group, a hexadecyl group, a 2-(2,4-di-tert-amylphenoxy)ethyl group, a 2-dodecyloxyethyl group, etc.) or an aryl group (for example, a phenyl group, an α- or β-naphthyl group, a 4-tolyl group, etc.). The alkyl group or the aryl group described above may be substituted with one or more substituents as defined for $R_4$ in general formula (III).

Of the couplers represented by general formula (III), those in which the total number of carbon atoms of the groups represented by $R_2$ and $R_3$ is not less than 6 are particularly preferred for achieving the objects of the present invention.

The 5-pyrazolone magenta couplers represented by general formula (I) may form a polymer, such as a dimer or higher polymer, by linking with each other through a divalent group or group having a higher valency at the substituent represented by W, Y or R, respectively. In such cases, the range of carbon atoms defined above for the preferred substituents is not restricted.

Typical examples of polymer couplers formed from the couplers represented by general formula (I) are a homopolymer and a copolymer, each containing a unit of an addition-polymerizable ethylenically unsaturated compound having a magenta dye forming coupler residue (a magenta color forming monomer). More specifically, the polymer contains a magenta color forming repeating unit represented by the general formula (IV) described below. Suitable copolymers may contain two or more kinds of magenta color forming repeating units represented by general formula (IV), and may contain one or more kinds of non-color forming ethylenic monomers as comonomer components.

General formula (IV) is shown below:

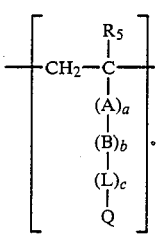

(IV)

wherein $R_5$ represents a hydrogen atom, an alkyl group having from 1 to 4 carbon atoms or a chlorine atom; A represents —CONH—, —COO— or a substituted or unsubstituted phenylene group; B represents a substituted or unsubstituted alkylene group, a substituted or unsubstituted phenylene group or a substituted or unsubstituted aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; a, b and c each represents 0 or 1; and Q represents a magenta coupler residue which is formed by removing a hydrogen atom from the W, Y or R substituents in the compound represented by general formula (I).

Of the polymers copolymers composed of a magenta color forming monomer capable of providing a coupler unit represented by general formula (IV) and a non-color forming ethylenic monomer are preferred.

Suitable examples of the non-color forming ehtylenic monomer (which does not undergo a coupling reaction with an oxidation product of an aromatic primary amine developing agent) include an acrylic acid (for example, acrylic acid, α-chloroacrylic acid, an α-alkylacrylic acid such as methacrylic acid, etc.), an ester or amide derived from an acrylic acid (for example, acrylamide, methacrylamide, n-butylacrylamide, tert-butylacrylamide, diacetoneacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, etc.), a vinyl ester (for example, vinyl acetate, vinyl propionate, vinyl laurate, etc.), acrylonitrile, methacrylonitrile, an aromatic vinyl compound (for example, styrene and derivatives thereof, such as, vinyl toluene, divinyl benzene, vinyl acetophenone, sulfo styrene, etc.), itaconic acid, citraconic acid, crotonic acid, vinylidene chloride, a vinyl alkyl ether (for example, vinyl ethyl ether, etc.), an ester of maleic acid, N-vinyl-2-pyrrolidone, 2- or 4-vinyl pyridine, etc.).

Of these monomers, an ester of acrylic acid, an ester of methacrylic acid, an ester of maleic acid and an aromatic vinyl compound are particularly preferred.

Two or more non-color forming ethylenic monomers as described above can be used together, if desired. For example, a combination of methyl acrylate and butyl acrylate, butyl acrylate and styrene, butyl methacrylate and methacrylic acid, methyl acrylate and diacetoneacrylamide, etc. can be used.

The ethylenically unsaturated monomer which is copolymerized with the vinyl monomer corresponding to the repeating unit represented by the above-described general formula (IV) can be selected so that the copolymer to be formed possesses good physical properties and/or chemical properties (for example, solubility, compatibility with a binder such as gelatin in a photographic colloid composition, flexibility, heat stability, etc.), as would be understood by one of ordinary skill in the field of polymer couplers.

The magenta polymer coupler used in the present invention can be prepared by dissolving an oleophilic polymer coupler obtained by polymerization of a vinyl monomer which provides the coupler unit represented by general formula (IV) described above, in an organic solvent and then dispersing the solution in a latex form into an aqueous solution of gelatin, or may be formed directly by an emulsion polymerization method.

With respect to the former case in which an oleophilic polymer coupler is dispersed in a latex from into an aqueous gelatin solution, the method as described in U.S. Pat. No. 3,451,820 can be used. With respect to the latter case in which an emulsion polymerization method is employed, the method as described in U.S. Pat. Nos. 4,080,211 and 3,370,952 can be used.

Preferred specific examples of the couplers represented by general formula (I) are set forth below, but the present invention should not be construed as being limited thereto.

M-1

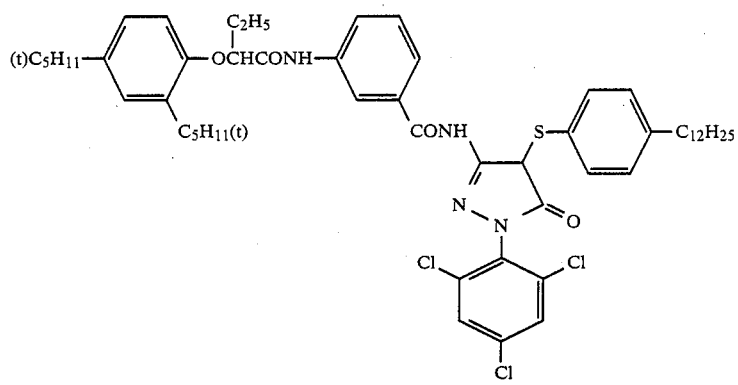

M-2

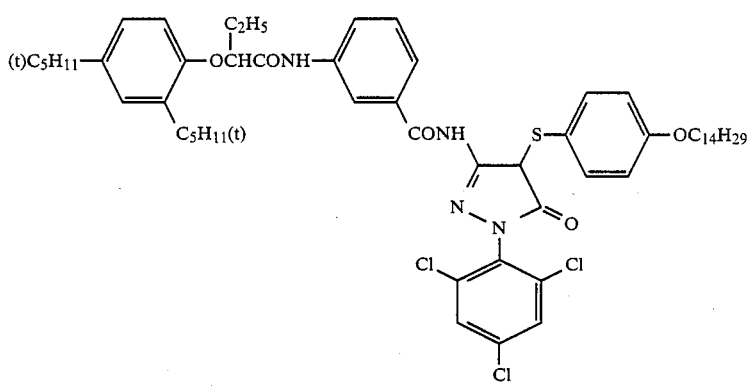

-continued
M-3
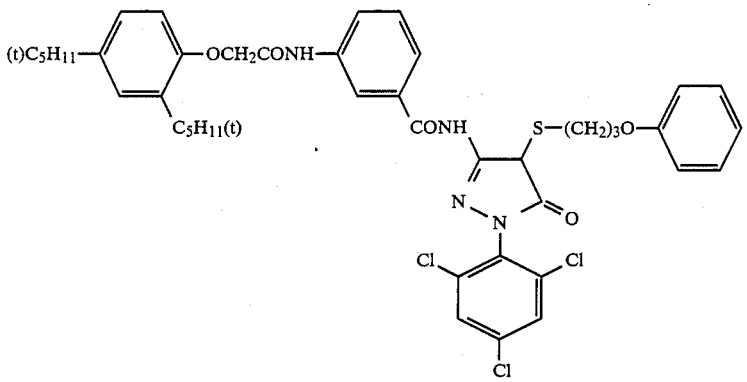
M-4
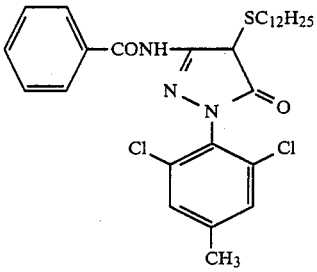
M-5
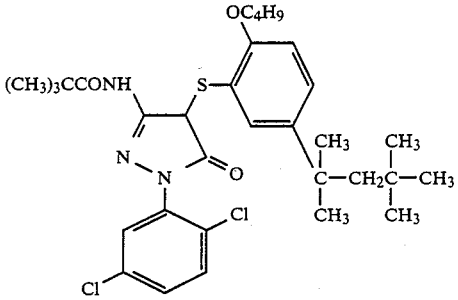
M-6
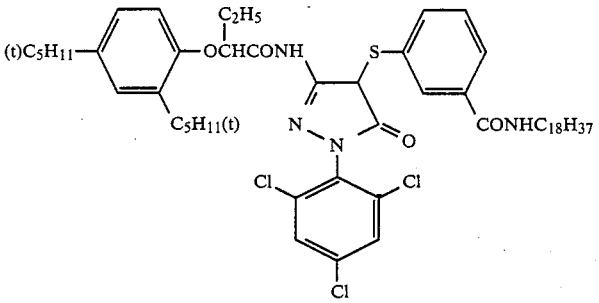
M-7
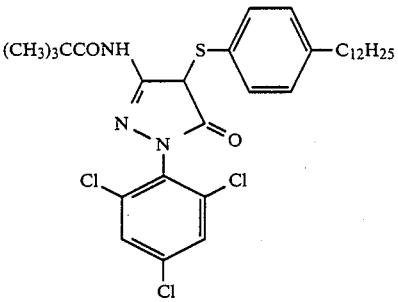

-continued
M-8
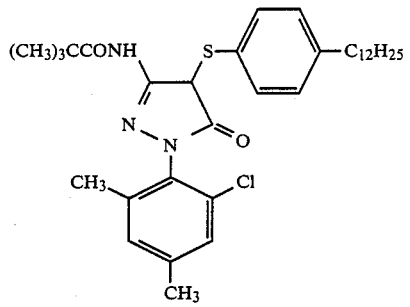
M-9
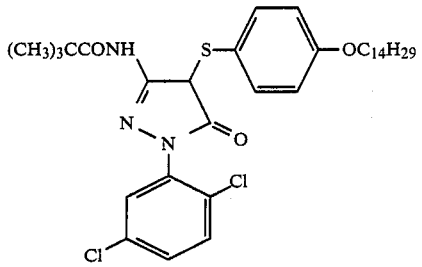
M-10
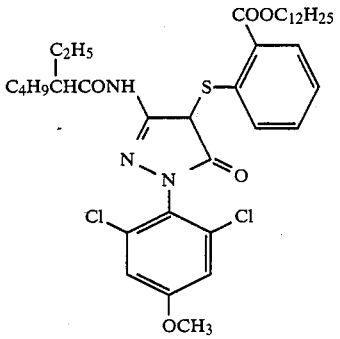
M-11
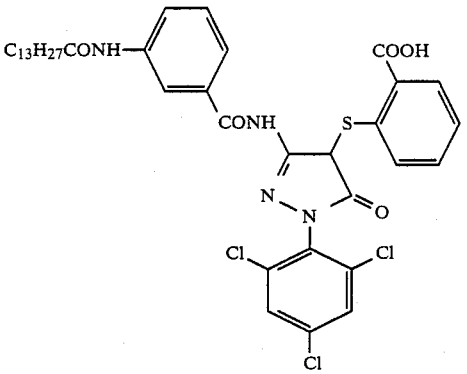
M-12
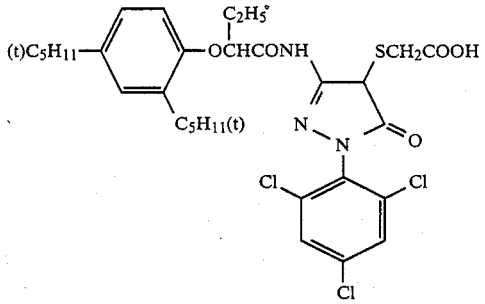

-continued
M-13
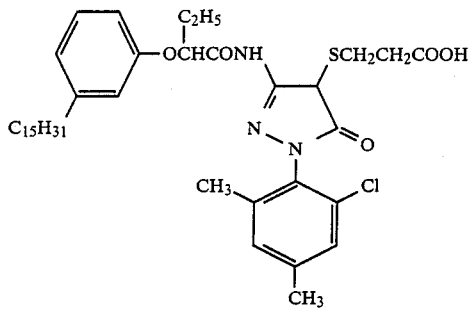
M-14
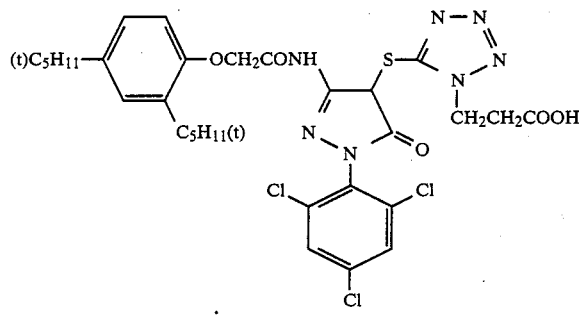
M-15
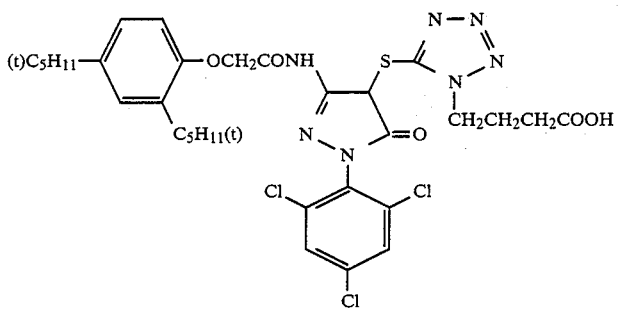
M-16
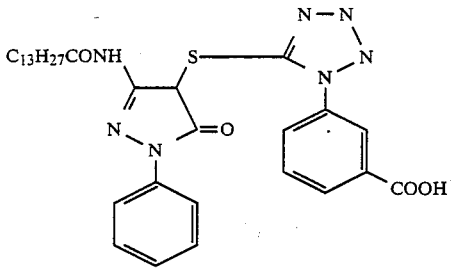
M-17
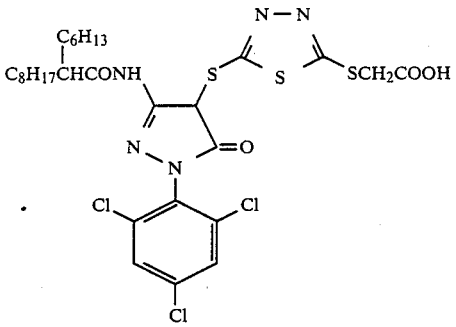

-continued
M-18
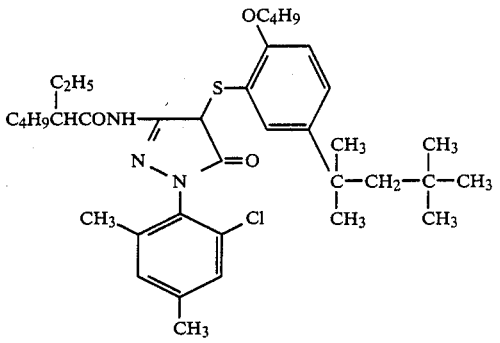
M-19
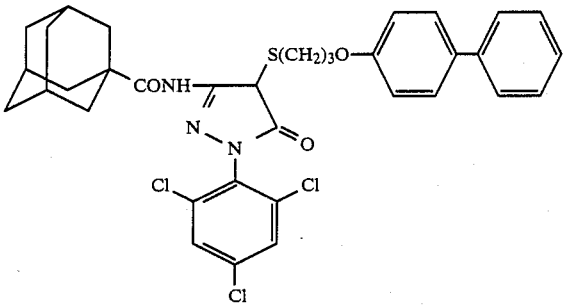
M-20
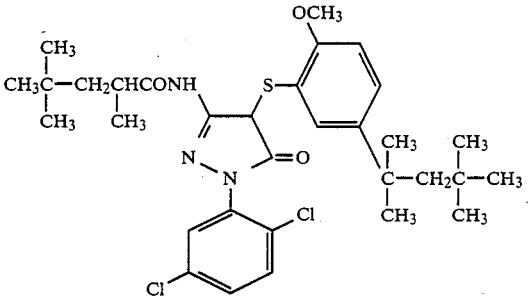
M-21
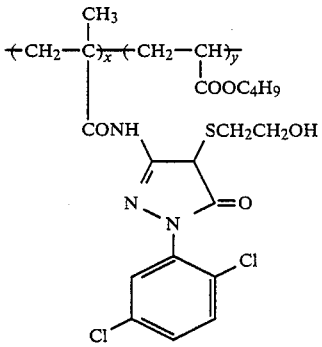
x:y = 45:55 (weight ratio)

-continued
M-22
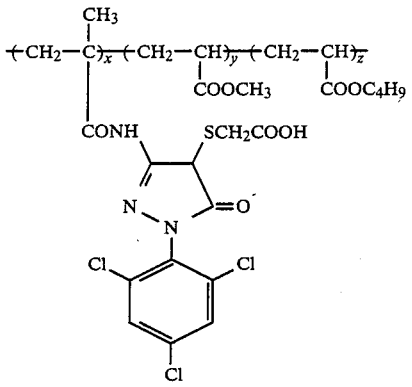
x:y:z = 50:25:25 (weight ratio)
M-23
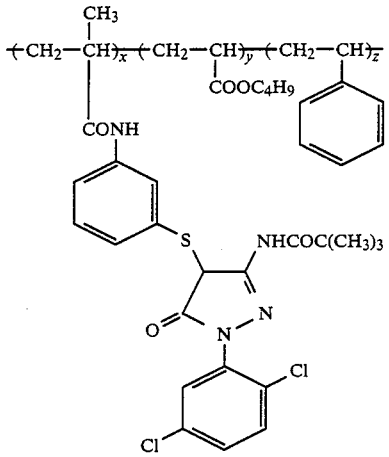
x:y:z = 50:30:20 (weight ratio)
M-24
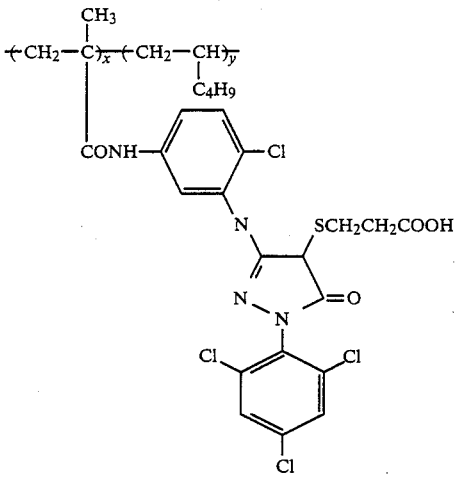
x:y = 50:50 (weight ratio)

-continued
M-25
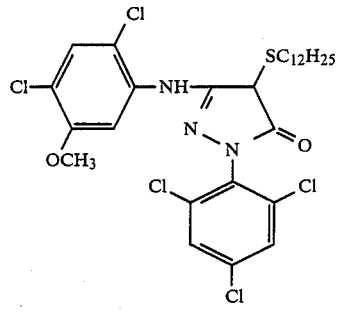
M-26
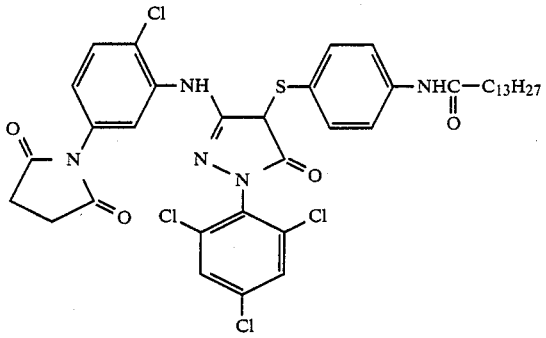
M-27
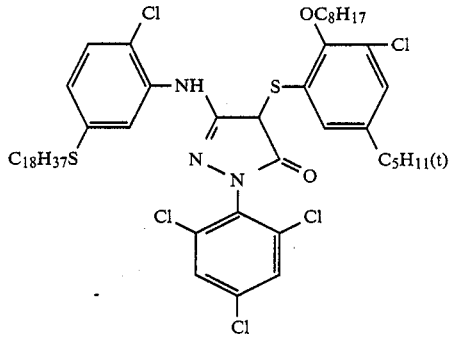
M-28
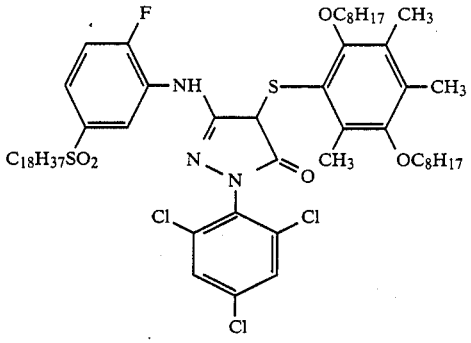
M-29
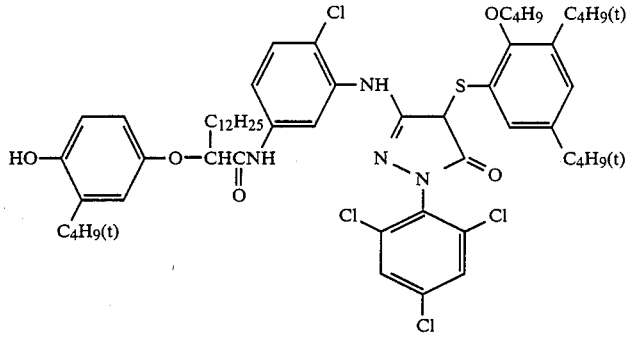

-continued
M-30
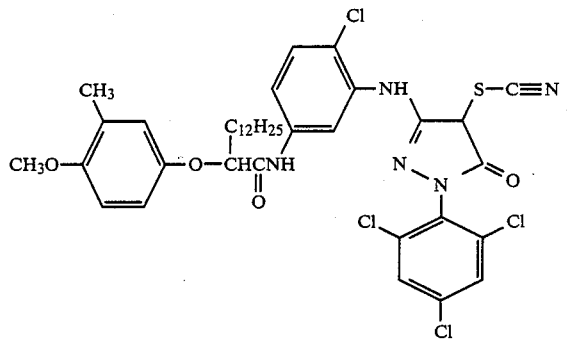
M-31
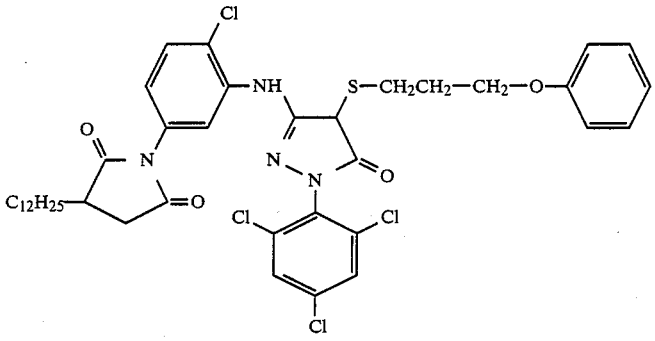
M-32
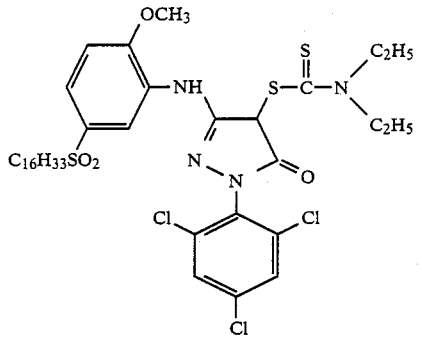
M-33
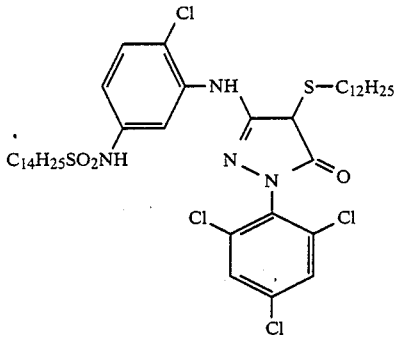

-continued
M-34
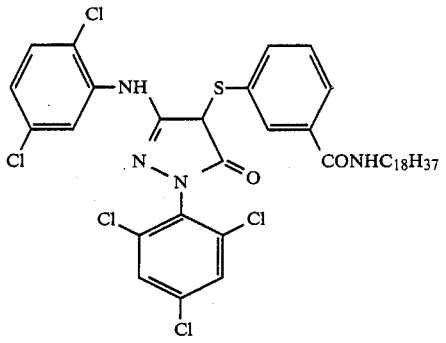
M-35
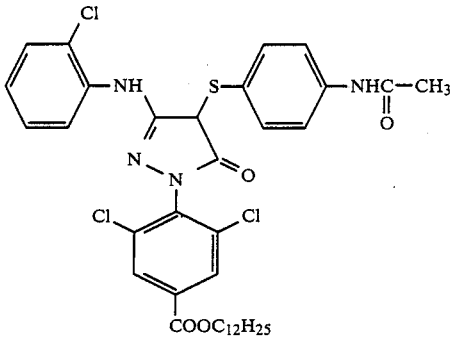
M-36
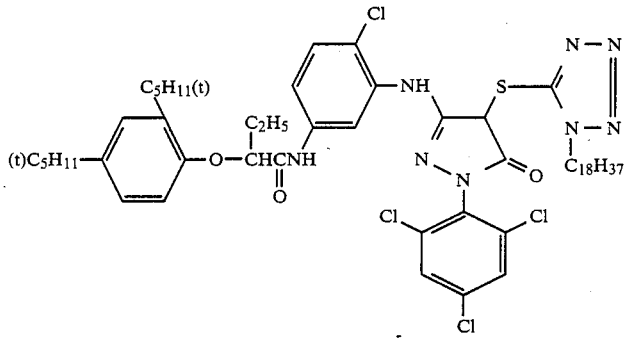
M-37
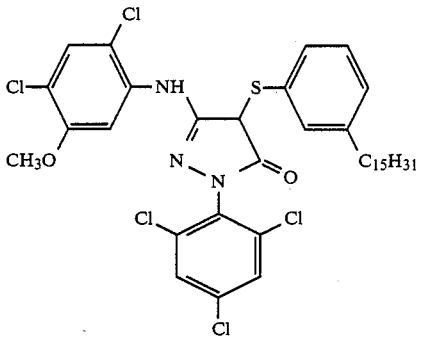

-continued
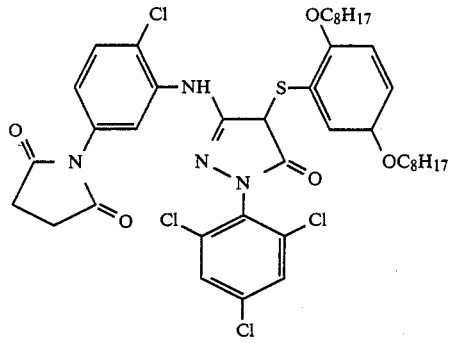
M-38
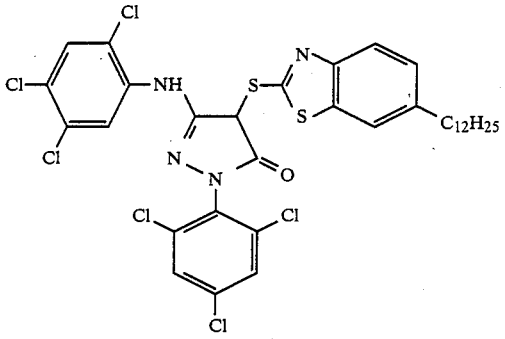
M-39
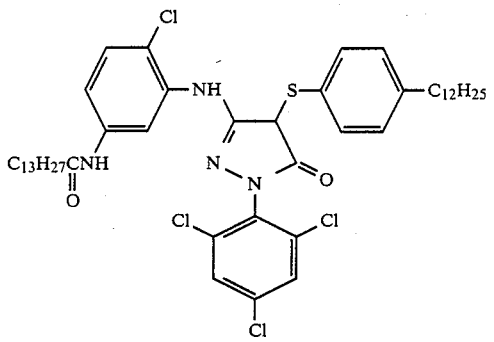
M-40
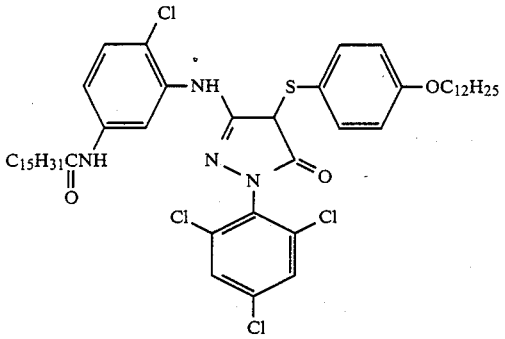
M-41

-continued
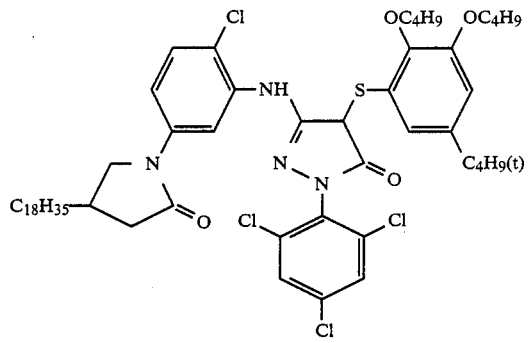
M-42
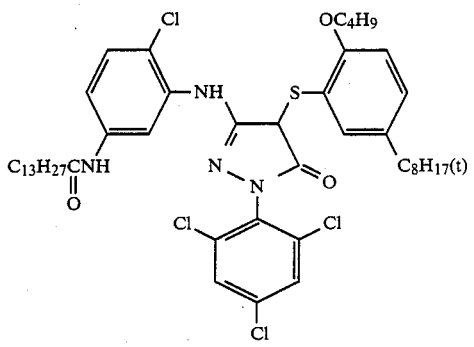
M-43
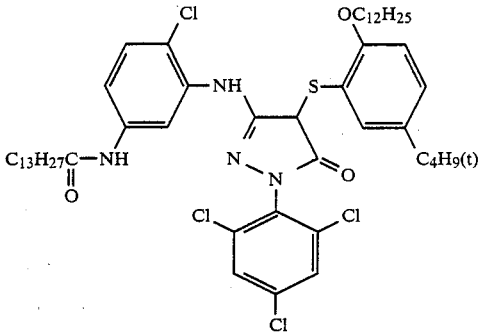
M-44
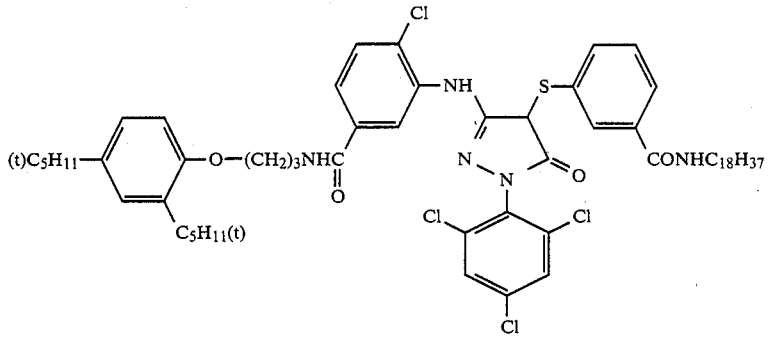
M-45

-continued
M-46
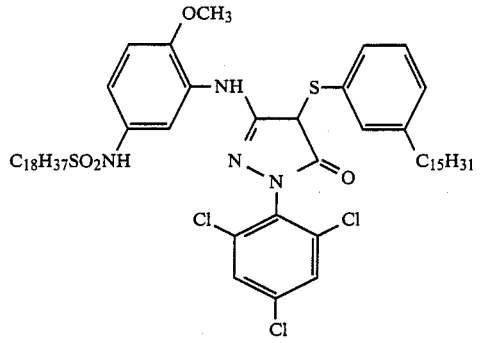
M-47
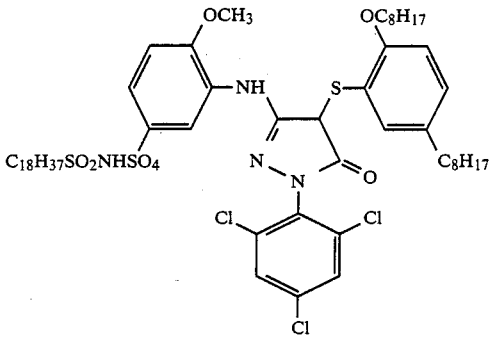
M-48
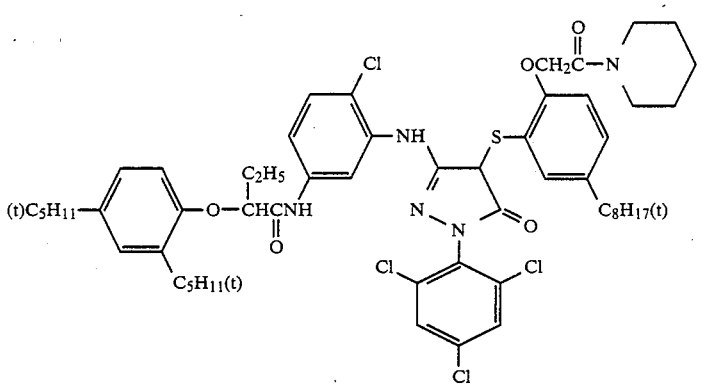
M-49
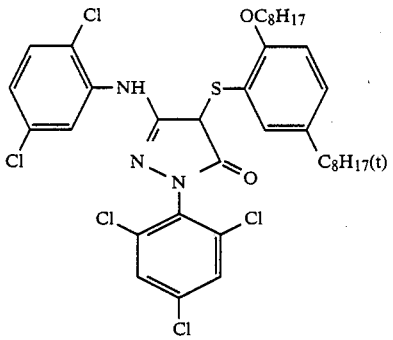

-continued

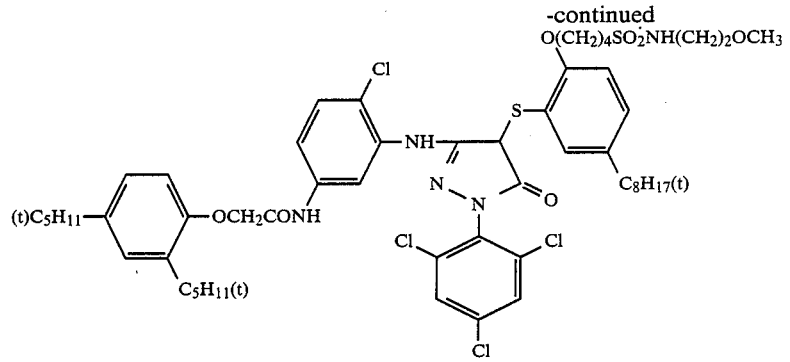

M-50

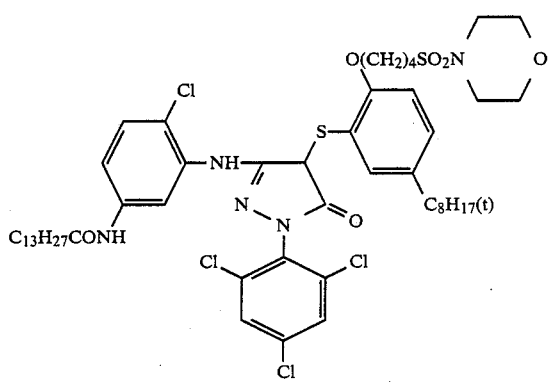

M-51

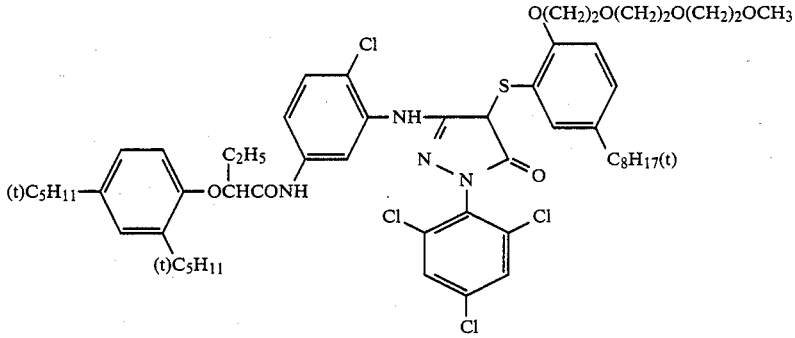

M-52

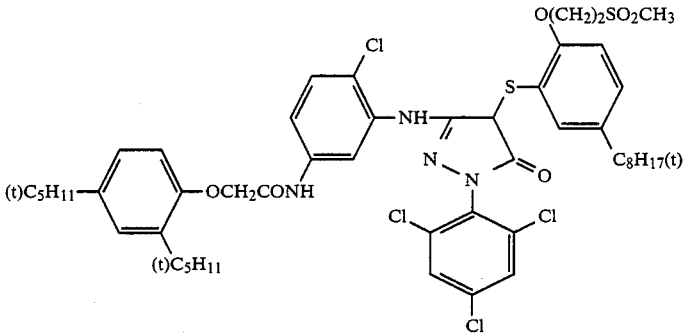

M-53

The 5-pyrazolone magenta couplers represented by general formula (I) used in the present invention can be synthesized according to the methods as described in U.S. Pat. Nos. 3,701,783 and 4,351,897, Japanese Patent Publication No. 34044/78, Japanese patent application (OPI) Nos. 62454/80 and 170854/85, etc., which are incorporated herein by reference.

The above-noted non-color forming, diffusion-resistant carboxylic acid compound which can be used in the present invention will be described in detail below.

The term "non-color forming" property means that the compound does not have a coupling component, and thus is not capable of undergoing a coupling reaction with the oxidation product of an aromatic primary amine type developing agent. Hence, these compounds do not provide a reaction product having a substantial absorption in the range of visible radiation upon color development.

The non-color forming, diffusion-resistant carboxylic acid compound which can be used in the present invention can be represented by the following general formula (V):

$$(R_6—COO^-)_l M^{l+} \quad (V)$$

wherein $R_6$ represents a substituent having a diffusion-resistant property: $M^{l+}$ represents a hydrogen ion, a metal ion or an ammonium ion; and l represents an integer from 1 to 4.

The group $R_6$ which imparts a diffusion-resistant property to the compound represented by general formula (V) has from 8 to 40 total carbon atoms, preferably from 12 to 32 total carbon atoms, and represents a straight chain or branched chain alkyl group (for example, a methyl group, an ethyl group, an n-propyl group, an n-butyl group, an isobutyl group, an n-pentyl group, an n-heptyl group, an n-nonyl group, an n-undecyl group, an n-tridecyl group, etc.), an alkenyl group (for example, an alkyl group, a decenyl group, a dodecenyl group, an oleyl group, etc.), a cycloalkyl group (for example, a cyclopropyl group, a cyclopentyl group, a cyclohexyl group, a norbonyl group, etc.), an alkynyl group (for example, a propargyl group, etc.), an aralkyl group (for example, a benzyl group, a phenethyl group, etc.), a cycloalkenyl group (for example, a cyclopentenyl group, a cyclohexenyl group, etc.), an aryl group (for example, a phenyl group, an α-naphthyl group, a β-naphthyl group, etc.), or a heterocyclic group (for example, a heterocyclic group derived from a 5-membered, 6-membered or 7-membered monocyclic ring containing as a hetero atom at least one of a nitrogen atom, an oxygen atom and a sulfur atom or a condensed ring thereof, with specific examples including a 2-pyridyl group, a 4-pyridyl group, a 2-quinolyl group, a 2-furyl group, a 2-thienyl group, a 4-pyrazolyl group, a 4-imidazolyl group, etc.). These groups may be substituted with one or more substituents so as to render the total number of carbon atoms within the above-noted range of from 8 to 40. Of these groups, those having 8 or more carbon atoms per se do not have to be substituted.

Suitable examples of the substituents for these groups include a halogen atom (for example, a fluorine atom, a chlorine atom, a bromine atom, an iodine atom, etc.), a nitro group, a cyano group, a hydroxy group, a carboxyl group, a sulfo group, a mercapto group, an alkoxy group (for example, a methoxy group, an ethoxy group, a dodecyloxy group, etc.), an aryloxy group (for example, a phenoxy group, a 2,4-di-tert-pentylphenoxy group, a 3-tert-butyl-4-hydroxyphenoxy group, a 3-pentadecylphenoxy group, a 2-chloro-4-tert-pentylphenoxy group, a 2-cyanophenoxy group, a 4-tert-octylphenoxy group, a 4-dodecyloxyphenoxy group, etc.), an alkylthio group (for example, a methylthio group, an ethylthio group, a dodecylthio group, etc.), an arylthio group (for example, a phenylthio group, a 4-dodecylphenylthio group, a 4-octyloxyphenylthio group, etc.), an alkylsulfonyl group (for example, a methylsulfonyl group, a benzylsulfonyl group, a dodecylsulfonyl group, etc.), an arylsulfonyl group (for example, a phenylsulfonyl group, a p-tolylsulfonyl group, a 4-dodecylphenylsulfonyl group, a 4-dodecyloxyphenylsulfonyl group, etc.), a carbonamido group (for example, an acetamido group, a benzamido group, an N-phenylacetamido group, a tetradecanamido group, etc.), a sulfonamido group (for example, a methylsulfonamido group, a phenylsulfonamido group, a p-tolylsulfonamido group, a hexadecylsulfonamido group, etc.), an amino group (for example, an amino group, a dimethylamino group, a pyrolidyl group, a piperidyl group, a dodecylamino group, an anilino group, etc.), a carbamoyl group (for example, a carbamoyl group, an N,N-dimethylcarbamoyl group, an N-dodecylcarbamoyl group, etc.), an alkoxycarbonyl group (for example, a methoxycarbonyl group, an ethoxycarbonyl group, a benzyloxycarbonyl group, a dodecyloxycarbonyl group, etc.), an aryloxycarbonyl group (for example, a phenoxycarbonyl group, a p-tert-butylphenoxycarbonyl group, etc.), an acyloxy group (for example, an acetoxy group, etc.), a sulfamoyl group (for example, a sulfamoyl group, a dimethylsulfamoyl group, a dihexylsulfamoyl group, etc.), an acyl group (for example, an acetyl group, a benzoyl group, etc.), an imido group (for example, a succinimido group, etc.), a ureido group (for example, a 3,3-dimethylureido group, etc.), an alkoxycarbonylamino group (for example, an ethoxycarbonylamino group, etc.), an aryl group (for example, a phenyl group, a p-tolyl group, a p-methoxyphenyl group, an α-naphthyl group, a β-naphthyl group, etc.), and a heterocyclic group (for example, a 1-imidazolyl group, a 1-pyrazolyl group, a 2-pyridyl group, a 4-pyridyl group, a 2-quinolyl group, a 2-furyl group, a 2-thienyl group, a 1-benzotriazolyl group, a phthalimido group, etc.), etc.

When $R_6$ represents an aryl group, a heterocyclic group or an aralkyl group, suitable substituents for such a group also include an alkyl group (for example, a methyl group, an ethyl group, an isopropyl group, a tert-butyl group, a tert-pentyl group, a tert-hexyl group, a 1,1,3,3-tetramethylbutyl group, etc.), an alkenyl group (for example, an allyl group, a hexenyl group, an oleyl group, etc.), an alkynyl group (for example, a propargyl group, etc.) and a cycloalkyl group (for example, a cyclopropyl group, a cyclopentyl group, a cyclohexyl group, etc.) in addition to the above-described substituents.

Preferred examples of the group represented by $R_6$ include an alkyl group substituted with a substituted phenoxy group (for example, a 2,4-di-tert-pentylphenoxy group, a 4-tert-octylphenoxy group, a 3-pentadecylphenoxy group, etc.) and an aryl group substituted with a carbonamido group or an alkoxy group.

In general formula (V), $M^{l+}$ can be selected from an ion of Group I elements in the Periodic Table (for example, $H^+$, $Na^+$, $K^+$, $Cs^+$, etc.), an ion of Group II elements in the Periodic Table (for example, $Mg^{2+}$, $Ca^{2+}$, $Ba^{2+}$, etc.), an ion of Group VIII elements in the Periodic Table (for example, $Fe^{2+}$, $Fe^{3+}$, $Co^{2+}$, $Co^{3+}$, $Ni^{2+}$, etc.), and an ammonium ion which may be represented by the formula

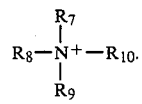

Of these anions, an anion of Group I, an anion of Group II and the ammonium ion are preferred. Particularly preferred ions are $H^+$, $Na^+$, $K^+$ and $NH_4^+$, and $H^+$ is most preferred.

In the above described formula, $R_7$, $R_8$, $R_9$ and $R_{10}$, which may be the same or different, each represents a hydrogen atom, an alkyl group (for example, a methyl group, an ethyl group, a tert-butyl group, etc.), a substituted alkyl group, an aralkyl group (for example, a benzyl group, a phenethyl group, etc.), a substituted aralkyl group, an aryl group (for example, a phenyl group, a naphthyl group, etc.) or a substituted aryl group, the total number of carbon atoms included in $R_7$, $R_8$, $R_9$ and $R_{10}$ being up to 20, and any two of $R_7$ to $R_{10}$ may be connected with each other to form a ring.

Suitable examples of the substituents for the alkyl group, the aralkyl group and the aryl group include a nitro group, a hydroxyl group, a cyano group, a sulfo group, an alkoxy group (for example, a methoxy group, etc.), an aryloxy group (for example, a phenoxy group, etc.), an acyloxy group (for example, an acetoxy group, etc.), a carbonamido group (for example, an acetamido group, etc.), a sulfonamido group (for example, a methylsulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), and a sulfonyl group (for example, a methylsulfonyl group, etc.), etc. When two or more of these substituents are present, they may be the same or different.

Preferred specific examples of the non-color forming and diffusion-resistant carboxylic acid compound which can be used in the present invention are set forth below, but the present invention should not be construed as being limited thereto.

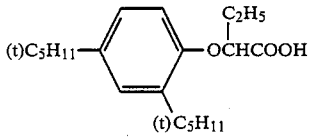
(A-1)

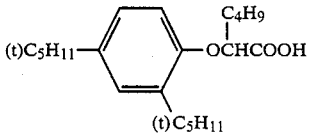
(A-2)

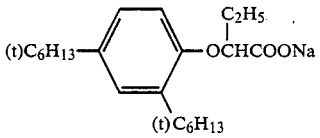
(A-3)

$C_{17}H_{35}—COO^-NH_4^+$ (A-4)

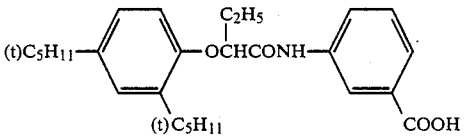
(A-5)

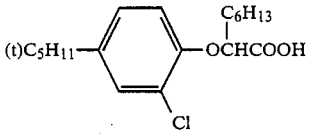
(A-6)

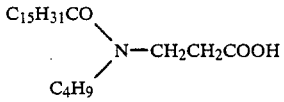
(A-7)

$C_{15}H_{31}COOH$ (A-8)

-continued

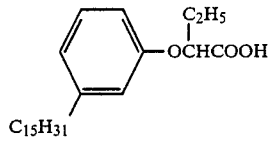
(A-9)

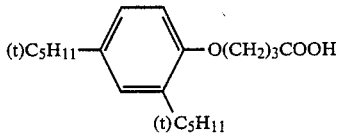
(A-10)

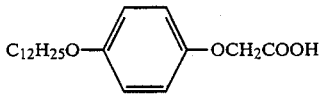
(A-11)

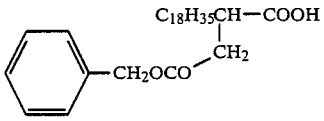
(A-12)

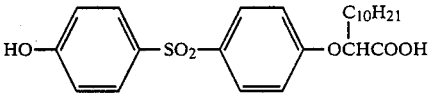
(A-13)

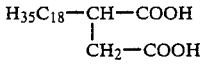
(A-14)

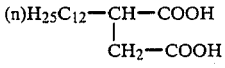
(A-15)

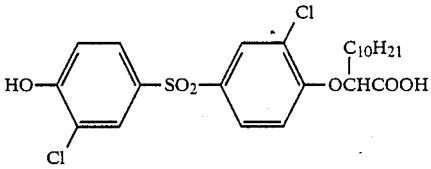
(A-16)

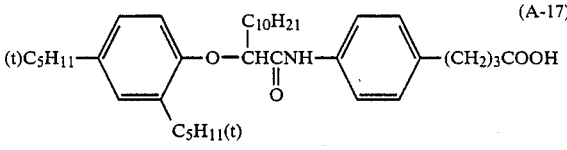
(A-17)

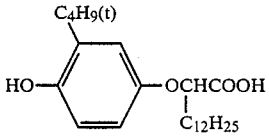
(A-18)

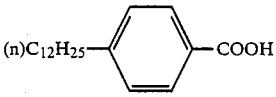
(A-19)

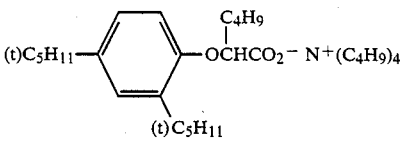
(A-20)

-continued (A-21)

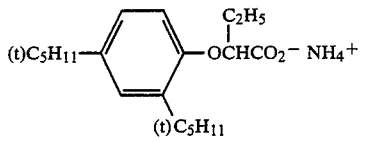

(A-22)

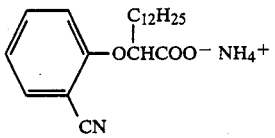

(A-23)

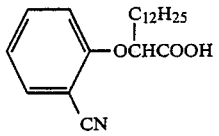

(A-24)

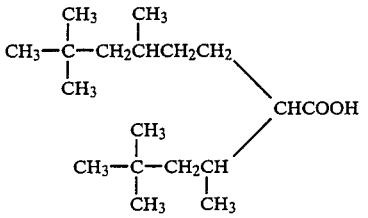

(A-25)

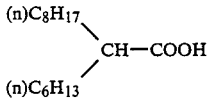

(A-26)

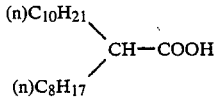

(A-27)

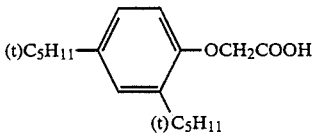

(A-28)

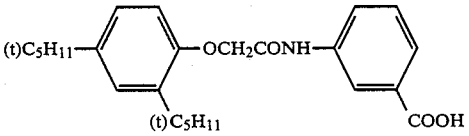

(A-29)

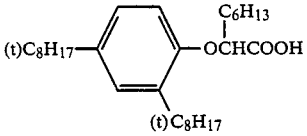

(A-30)

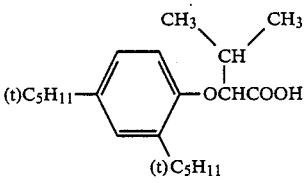

-continued (A-31)

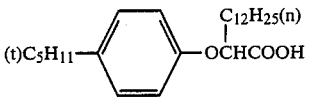

(A-32)

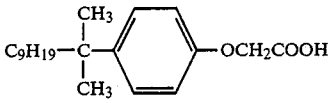

(A-33)

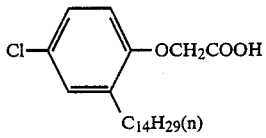

(A-34)

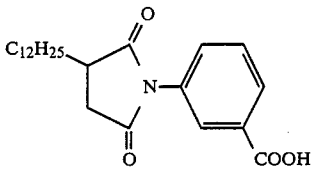

(A-35)

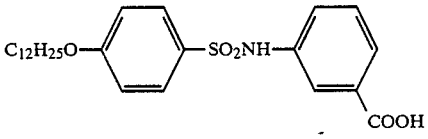

The 5-pyrazolone magenta coupler represented by general formula (I) and the carboxylic acid compound according to the present invention are present in the same layer. The amount of the magenta coupler to be added is from about 0.01 g/m$^2$ to about 1.0 g/m$^2$, preferably from 0.05 g/m$^2$ to 0.5 g/m$^2$, and more preferably from 0.1 g/m$^2$ to 0.3 g/m$^2$.

The amount of the carboxylic acid compound to be added is from about 0.01 to about 100 times by weight, preferably from 0.05 to 20 times by weight, and more preferably from 0.1 to 5 times by weight based on the magenta coupler according to the present invention.

The magenta coupler and the carboxylic acid compound according to the present invention can be present in any layer of the color photographic light-sensitive material, as long as they are both added to the same layer. However, they are preferably present in a green-sensitive silver halide emulsion layer or an adjacent layer thereto, and more preferably in a green-sensitive silver halide emulsion layer.

The magenta coupler according to the present invention can be dispersed and mixed together with one or more of the carboxylic acid compounds according to the present invention. Further, they may be dispersed together with a conventionally known organic solvent having a high boiling point, as described below.

In the photographic emulsion layers of the photographic light-sensitive material according to the present invention, preferred silver halides are silver iodobromide, silver iodochloride or silver iodochlorobromide, each containing about 30 mol % or less of silver iodide. Silver iodobromide containing from about 2 mol % to about 25 mol % of silver iodide is particularly preferred.

Silver halide grains in the silver halide emulsion may have a regular crystal structure, for example, a cubic, octahedral or tetradecahedral structure, etc., an irregular crystal structure, for example, a spherical or tabular structure, etc., a crystal defect, for example, a twin plane, etc., or they may be a composite structure thereof.

The grain size of the silver halide may be varied, and includes fine grains having a diameter of projected area of about 0.2 micron or less, up to large size grains having a diameter of projected area up to about 10 microns. Further, a polydispersed emulsion and a monodispersed emulsion may be used.

The silver halide photographic emulsion used in the present invention can be prepared using known methods, for example, those as described in *Research Disclosure,* No. 17643 (December, 1978), pages 22 to 23, "I. Emulsion Preparation and Types" and ibid., No. 18716 (November, 1979), page 648, P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964), etc.

Monodispersed emulsions as described in U.S. Pat. Nos. 3,574,628 and 3,655,394, and British Pat. No. 1,413,748, etc. are preferably used in the present invention.

Further, tabular silver halide grains having an aspect ratio of about 5 or more can be employed in the present invention. The tabular grains may be easily prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, and British Pat. No. 2,112,157, etc.

The crystal structure of the silver halide grains may be uniform, may be composed of different halide compositions between the inner portion and the outer portion, or may have a stratified structure.

Further, silver halide emulsions in which silver halide grains having different compositions are connected by epitaxial junctions or silver halide emulsions in which silver halide grains are connected to compounds other than silver halide, such as silver thiocyanate, lead oxide, etc., may also be employed.

Moreover, a mixture of silver halide grains having different crystal structures may be used, if desired.

The silver halide emulsions used in the present invention are usually subjected to the well known steps of physical ripening, chemical ripening and spectral sensitization. Various kinds of additives which can be employed in these steps are described in *Research Disclosure,* No. 17643 (December, 1978) and ibid., No. 18716 (November, 1979), and relevant portions thereof are summarized in Table A shown below.

Further, other known photographic additives which can be used in the present invention are also described in the above mentioned literature, and relevant portions thereof are also summarized in Table A below:

TABLE A

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Super Sensitizers | Pages 23 to 24 | Page 648, right column to page 649, right column |
| 4. Whitening Agents | Page 24 | |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

In the present invention, various conventional color couplers can be employed, and specific examples thereof are described in the patents cited in *Research Disclosure,* No. 17643, Sections "VII-C" to "VII-G".

Preferred yellow couplers used in the present invention include those as described in U.S. Pat. Nos. 3,933,501, 4,022,620, 4,326,024 and 4,401,752, Japanese Patent Publication No. 10739/83, British Pat. Nos. 1,425,020 and 1,476,760, etc.

Preferred magenta couplers used in the present invention include 5-pyrazolone type and pyrazoloazole type compounds. Magenta couplers as described in U.S. Pat. Nos. 4,310,619 and 4,351,897, European Pat. No. 73,636, U.S. Pat. Nos. 3,061,432 and 3,725,067, *Research Disclosure,* No. 24220 (June, 1984), Japanese patent application (OPI) No. 33552/85, *Research Disclosure,* No. 24230 (June, 1984), Japanese patent application (OPI) No. 43659/85, U.S. Pat. Nos. 4,500,630 and 4,540,654, etc. are particularly preferred.

Suitable cyan couplers used in the present invention include naphthol type and phenol type couplers. Cyan couplers as described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German patent application (OLS) No. 3,329,729, European Pat. No. 121,365A, U.S. Pat. Nos. 3,446,622, 4,333,999, 4,451,559 and 4,427,767, European Pat. No. 161,626A, etc. are preferred.

Preferred colored couplers for correcting undesirable absorptions of dyes formed are those as described in *Research Disclosure,* No. 17643, Section "VII-G", U.S. Pat. No. 4,163,670, Japanese Patent Publication No. 39413/82, U.S. Pat. Nos. 4,004,929 and 4,138,258, British Pat. No. 1,146,368, etc.

As couplers capable of forming appropriately diffusible dyes are those as described in U.S. Pat. No. 4,366,237, British Pat. No. 2,125,570, European Pat. No. 96,570, West German patent application (OLS) No. 3,234,533, etc.

Typical examples of polymerized dye forming couplers are described in U.S. Pat. Nos. 3,451,820, 4,080,211 and 4,367,282, British Pat. No. 2,102,173, etc.

Couplers capable of releasing a photographically useful residue during the course of coupling can also preferably employed in the present invention. As DIR couplers capable of releasing a development inhibitor, those as described in the patents cited in *Research Disclosure,* No. 17643, Section "VII-F" described above, Japanese patent application (OPI) Nos. 151944/82, 154234/82 and 184248/85, U.S. Pat. No. 4,248,962, etc. are preferred.

Preferred couplers which imagewise release a nucleating agent or a development accelerator at the time of development include those as described in British Pat. Nos. 2,097,140 and 2,131,188, Japanese patent application (OPI) Nos. 157638/84 and 170840/84, etc.

Furthermore, competing couplers such as those described in U.S. Pat. No. 4,130,427, etc., poly-equivalent couplers such as those described in U.S. Pat. Nos. 4,283,472, 4,338,393 and 4,310,618, etc., DIR redox compound releasing couplers such as those described in Japanese patent application (OPI) No. 185950/85, etc., couplers capable of releasing a dye which converts into a colored form after being released such as those described in European Pat. No. 173,302A, etc., and the like may also be employed in the photographic light-sensitive material of the present invention.

The couplers suitable for use in the present invention can be introduced into the photographic light-sensitive material according to various known dispersing methods.

Suitable examples of organic solvents having a high boiling point which can be employed in an oil droplet-in-water type dispersing method are described in U.S. Pat. No. 2,322,027, etc.

The processes and effects of latex dispersing methods, and specific examples of latexes for impregnation, are described in U.S. Pat. No. 4,199,363, West German patent application (OLS) Nos. 2,541,274 and 2,541,230, etc.

Suitable supports which can be used in the present invention are described, for example, in *Research Disclosure,* No. 17643, page 28 and ibid., No. 18716, page 647, right column to page 648, left column, as mentioned above.

The color photographic light-sensitive material according to the present invention can be subjected to development processing in a conventional manner, such as described in *Research Disclosure,* No. 17643, pages 28 to 29 and ibid., No. 18716, page 651, left column to right column, as mentioned above.

After the color development step and a bleach-fixing or fixing step, the color photographic material according to the present invention is usually subjected to a water washing process or a stabilizing process.

The water washing step is generally conducted by a countercurrent water washing step using two or more tanks in order to reduce the amount of water used. For stabilizing processing, a representative example is a multistage countercurrent stabilizing process as described in Japanese patent application (OPI) No. 8543/82, which is conducted in place of the water washing step.

The present invention is described hereinafter in detail with reference to the following examples, but the present invention is not to be construed as being limited thereto. Unless otherwise indicated, all parts, percents, ratios and the like are by weight.

EXAMPLE 1

Sample 101:

On a polyethylene laminated paper support provided with a subbing layer were coated layers having the compositions set forth below to prepare Sample 101.

| First Layer: Emulsion Layer | |
|---|---|
| Negative type silver chlorobromide emulsion (silver bromide: 10 mol %, average particle size: 0.5 μm, coefficient of variation concerning particle size: 12%) | 0.6 g/m$^2$ |
| EX-12* | 0.5 g/m$^2$ |
| HBS-1 | 0.6 g/m$^2$ |
| Gelatin | 2.5 g/m$^2$ |
| Second Layer: Protective Layer | |
| H-1 | 0.07 g/m$^2$ |
| Gelatin | 1.5 g/m$^2$ |

*The chemical structures of compounds used in this Example are shown hereafter.

Samples 102 to 104:

Samples 102 to 104 were prepared in the same manner as described for Sample 101, except for using equimolar amounts of Magenta Couplers M-1, M-5 and M-43 according to the present invention in place of Coupler EX-12 in the emulsion layer of Sample 101, respectively.

Samples 105 to 108:

Samples 105 to 108 were prepared in the same manner as described for Samples 101 to 104, except for adding Carboxylic Acid Compound A-10 according to the present invention in an amount of 0.1 g/m$^2$ to the emulsion layer of Samples 101 to 104, respectively.

These samples were subjected to exposure for sensitometry and then underwent color development processing using Processing Steps A and B shown below, respectively.

| Processing Step A | Temperature | Time |
|---|---|---|
| Color Development A | 35° C. | 45 sec |
| Bleach-Fixing | 30–36° C. | 45 sec |
| Stabilizing (1) | 30–37° C. | 20 sec |
| Stabilizing (2) | 30–37° C. | 20 sec |
| Stabilizing (3) | 30–37° C. | 20 sec |
| Stabilizing (4) | 30–37° C. | 30 sec |
| Drying | 70–80° C. | 60 sec |

In the above described processing steps, the stabilizing steps were carried out using a countercurrent stabilizing process from Stabilizing (4) to Stabilizing (1).

Processing Step B

Processing Step B is the same as Processing Step A, except for using Color Development B in place of Color Development A.

The composition of each processing solution used in Processing Steps A and B is set out below.

| Color Developing Solution A: | |
|---|---|
| Water | 800 ml |
| Ethylenediaminetetraacetic Acid | 2.0 g |
| Triethanolamine | 8.0 g |
| Benzyl Alcohol | 15.0 ml |
| Sodium Chloride | 1.4 g |
| Potassium Carbonate | 25 g |
| N—Ethyl-N—(β-methanesulfonamidoethyl)-3-methyl-4-aminoaniline Sulfate | 5.0 g |
| N,N—Diethylhydroxylamine | 4.2 g |
| 5,6-Dihydroxybenzene-1,2,4-trisulfonic Acid | 0.3 g |
| Fluorescent Whitening Agent (4,4'-Diaminostilbene type) | 2.0 g |
| Water to make | 1,000 ml |
| pH at 25° C. | 10.10 |

Color Developing Solution B:

The same as Color Developing Solution A, except for eliminating benzyl alcohol.

| Bleach-Fixing Solution: | |
|---|---|
| Water | 400 ml |
| Ammonium Thiosulfate (70%) | 100 ml |
| Sodium Sulfite | 18 g |
| Ammonium Iron (III) Ethylenediaminetetraacetate | 55 g |
| Disodium Ethylenediaminetetraacetate | 3 g |
| Glacial Acetic Acid | 8 g |
| Water to make | 1,000 ml |
| pH at 25° C. | 5.5 |
| Stabilizing Solutions (1)–(4): | |
| Formalin (37%) | 0.1 g |
| Formalin-Sulfite Adduct | 0.7 g |
| 5-Chloro-2-methyl-4-isothiazolin-3-one | 0.02 g |
| 2-Methyl-4-isothiazolin-3-one | 0.01 g |
| Cupric Sulfate | 0.005 g |
| Water to make | 1,000 ml |
| pH at 25° C. | 4.0 |

The samples thus processed were subjected to densitometry to evaluate photographic properties. The results obtained are shown in Table 1 below.

TABLE 1

| | | | Processing Step A | | | Processing Step B | | |
|---|---|---|---|---|---|---|---|---|
| Sample | Coupler | Additive | Fog | Relative* Sensitivity | Maximum Density | Fog | Relative* Sensitivity | Maximum Density |
| 101 (Comparison) | EX-12 | — | 0.04 | 100 | 1.30 | 0.04 | 76 | 0.96 |
| 102 (Comparison) | M-1 | — | 0.06 | 132 | 2.46 | 0.06 | 105 | 2.23 |
| 103 (Comparison) | M-5 | — | 0.06 | 129 | 2.37 | 0.05 | 105 | 2.18 |
| 104 (Comparison) | M-43 | — | 0.07 | 138 | 2.54 | 0.06 | 110 | 2.30 |
| 105 (Comparison) | EX-12 | A-10 | 0.04 | 105 | 1.30 | 0.04 | 85 | 1.05 |
| 106 (Present Invention) | M-1 | " | 0.06 | 138 | 2.45 | 0.06 | 132 | 2.40 |
| 107 (Present Invention) | M-5 | " | 0.06 | 135 | 2.38 | 0.06 | 129 | 2.35 |
| 108 (Present Invention) | M-43 | " | 0.06 | 141 | 2.54 | 0.06 | 138 | 2.54 |

*The sensitivity is measured as a reciprocal of the exposure amount required for obtaining a magenta density of fog +0.3, and the sensitivity of Sample 101 processed with Processing Step A is taken as 100 and the other sensitivities are relative values thereto.

From the results shown in Table 1, it is apparent that Samples 106 to 108 according to the present invention provide high sensitivity and high color density when developed in accordance with Processing Steps A and B. Further, the color forming properties of these Samples hardly deteriorate, although severe decreases in sensitivity and color density are observed with Samples 102 to 104 (which contain the same magenta couplers, but no carboxylic acid compound according to the present invention), when these samples are processed with Processing Step B without using benzyl alochol.

EXAMPLE 2

Sample 201:

On a cellulose triacetate film support provided with a subbing layer were coated layers having the compositions set forth below to prepare a multilayer color photographic light-sensitive material, which was designated as Sample 201.

With respect to the compositions of the respective layers, coated amounts of most components are shown in units of g/m$^2$, coated amounts of silver halide and colloidal silver are shown by the coated amount of silver in units of g/m$^2$, and the sensitizing dyes employed are shown as a molar amount per mol of silver halide present in the layer.

| First Layer: Antihalation Layer | |
|---|---|
| Black colloidal silver | 0.18 (as silver) |
| Gelatin | 0.40 |
| **Second Layer: Intermediate Layer** | |
| 2,5-Di-tert-pentadecylhydroquinone | 0.18 |
| EX-1* | 0.07 |
| EX-3 | 0.02 |
| U-1 | 0.08 |
| U-2 | 0.08 |
| HBS-1 | 0.10 |
| HBS-2 | 0.02 |
| Gelatin | 1.04 |
| **Third Layer: First Red-Sensitive Emulsion Layer** | |
| Silver Iodobromide Emulsion (silver iodide: 6 mol %, average particle size: 0.8 μm) | 0.55 (as silver) |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-11 | 0.008 |
| Gelatin | 1.20 |
| **Fourth Layer: Second Red-Sensitive Emulsion Layer** | |
| Silver Iodobromide Emulsion (silver iodide: 8 mol %, average particle size: 0.85 μm) | 1.20 (as silver) |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.300 |
| EX-3 | 0.050 |
| EX-10 | 0.004 |
| HBS-2 | 0.050 |
| Gelatin | 1.30 |
| **Fifth Layer: Third Red-Sensitive Emulsion Layer** | |
| Silver Iodobromide Emulsion (silver iodide: 14 mol %, average particle size: 1.5 μm) | 1.60 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |

-continued

| | |
|---|---|
| Sensitizing Dye IV | $3.1 \times 10^{-5}$ |
| EX-5 | 0.150 |
| EX-3 | 0.055 |
| EX-4 | 0.060 |
| EX-11 | 0.005 |
| HBS-1 | 0.32 |
| Gelatin | 1.63 |
| Sixth Layer: Intermediate Layer | |
| Gelatin | 1.06 |
| Seventh Layer: First Green-Sensitive Emulsion Layer | |
| Silver Iodobromide Emulsion (silver iodide: 6 mol %, average particle size: 0.8 μm) | 0.40 (as silver) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| Gelatin | 0.75 |
| Eighth Layer: Second Green-Sensitive Emulsion Layer | |
| Silver Iodobromide Emulsion (silver iodide: 9 mol %, average particle size: 0.85 μm) | 0.80 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.150 |
| EX-8 | 0.010 |
| EX-1 | 0.008 |
| EX-7 | 0.012 |
| HBS-1 | 0.60 |
| Gelatin | 1.10 |
| Ninth Layer: Third Green-Sensitive Emulsion Layer | |
| Silver Iodobromide Emulsion (silver iodide: 12 mol %, average particle size: 1.3 μm) | 1.5 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| M-2 | 0.086 |
| EX-1 | 0.035 |
| HBS-2 | 0.55 |
| Gelatin | 1.74 |
| Tenth Layer: Yellow Filter Layer | |
| Yellow Collodial Silver | 0.05 (as silver) |
| 2,5-Di-tert-pentadecylhydroquinone | 0.03 |
| Gelatin | 0.95 |
| Eleventh Layer: First Blue-Sensitive Emulsion Layer | |
| Silver Iodobromide Emulsion (silver iodide: 6 mol %, average particle size: 0.6 μm) | 0.24 (as silver) |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| Twelfth Layer: Second Blue-Sensitive Emulsion Layer | |
| Silver Iodobromide Emulsion (silver iodide: 10 mol %, average particle size: 1.0 μm) | 0.45 (as silver) |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Thirteenth Layer: Third Blue-Sensitive Emulsion Layer | |
| Silver Iodobromide Emulsion (silver iodide: 10 mol %, average particle size: 1.8 μm) | 0.77 (as silver) |
| Sensitizing Dye VIII | $2.2 \times 10^{-4}$ |
| EX-9 | 0.20 |
| HBS-1 | 0.70 |
| Gelatin | 0.69 |
| Fourteenth Layer: First Protective Layer | |
| Silver Iodobromide Emulsion (silver iodide: 1 mol %, average particle size: 0.07 μm) | 0.5 (as silver) |
| U-1 | 0.11 |
| U-2 | 0.17 |
| HBS-1 | 0.90 |
| Gelatin | 1.00 |
| Fifteenth Layer: Second Protective Layer | |
| Polymethyl acrylate particles (diameter: about 1.5 μm) | 0.54 |
| S-1 | 0.05 |
| S-2 | 0.20 |
| Gelatin | 0.72 |

*The chemical structures of compounds used in this Example are shown hereafter.

Gelatin Hardener H-2 and a surface active agent were added to each of the layers in addition to the above described components.

Samples 202 and 203:

Samples 202 and 203 were prepared in the same manner as described for Sample 201, except for using equimolar amounts of M-44 and M-25 in place of M-2 added to the ninth layer of Sample 201, respectively.

Samples 204 to 215:

Samples 204 to 215 were prepared in the same manner as described for Samples 201 to 203, except for adding the carboxylic acid compounds shown in Table 2 below in an amount of 0.05 g/m$^2$ to the ninth layer of Samples 201 to 203, respectively.

These samples were imagewise exposed and then subjected to color development processing shown below either: (a) immediately (condition (A) or (b) after preservation at 40° C. and 80% relative humidity for 14 days (Condition B).

| Color Development Processing Step | Time |
|---|---|
| Color Development | 3 min. 15 sec. |
| Bleaching | 1 min. |
| Bleach-Fixing | 3 min. 15 sec. |
| Washing with Water (1) | 40 sec. |
| Washing with Water (2) | 1 min. |
| Stabilizing | 40 sec. |
| Drying (at 50° C.) | 1 min. 15 sec. |

In the above described processing steps, the washing with water steps were carried out using a countercurrent water washing process from Washing with Water (2) to Washing with Water (1).

The composition of each processing solution is set forth below.

The amounts of replenishing solutions for the processing solutions were 1200 ml/m$^2$ of the color photographic light-sensitive material with respect to the color development step, and 800 ml/m$^2$ of the color photographic light-sensitive material with respect to other processing steps, including the water washing step. Further, the amount of processing solution carried over from the processing bath to the water washing step was 50 ml/m$^2$ of the color photographic light-sensitive material.

| | Tank | Replenisher |
|---|---|---|
| Color Developing Solution: | | |
| Diethylenetriaminepentaacetic Acid | 1.0 g | 1.1 g |
| 1-Hydroxyethylidene-1,1-diphosphonic Acid | 2.0 g | 2.2 g |
| Sodium Sulfite | 4.0 g | 4.4 g |
| Potassium Carbonate | 30.0 g | 32.0 g |
| Potassium Bromide | 1.4 g | 0.7 g |

-continued

| | Tank | Replenisher |
|---|---|---|
| Potassium Iodide | 1.3 mg | — |
| Hydroxylamine Sulfate | 2.4 g | 2.6 g |
| 4-(N—Ethyl-N—β-hydroxyethyl amino)-2-methylaniline Sulfate | 4.5 g | 5.0 g |
| Water to make | 1,000 ml | 1,000 ml |
| pH | 10.00 | 10.05 |
| Bleaching Solution: (both Mother Solution and Replenisher) | | |
| Ammonium Iron (III) Ethylenediamine-tetraacetate | | 120.0 g |
| Disodium Ethylenediaminetetraacetate | | 10.0 g |
| Ammonium Nitrate | | 10.0 g |
| Ammonium Bromide | | 100.0 g |
| Bleach Accelerating Agent: | | $5 \times 10^{-3}$ mol |
| $H_3C$ \ / $CH_3$ N—$(CH_2)_2$—S—S—$(CH_2)_2$—N $H_3C$ / \ $CH_3$ | | |
| pH adjusted to 6.3 with aqueous ammonia | | |
| Water to make | | 1.0 liter |
| Bleach-Fixing Solution: (both Tank and Replenisher) | | |
| Ammonium Iron (III) Ethylenediamine-tetraacetate | | 50.0 g |
| Disodium Ethylenediaminetetraacetate | | 5.0 g |
| Sodium Sulfite | | 12.0 g |
| Aqueous Solution of Ammonium Thiosulfate (70% (wt/vol)) | | 240.0 ml |
| pH adjusted to 7.3 with aqueous ammonia | | |
| Water to make | | 1.0 liter |

Washing Water:

City water containing 32 mg/l of calcium ion and 7.3 mg/l of magnesium ion was passed through a column filled with an H type strong acidic cation exchange resin and an OH type strong basic anion exchange resin to prepare washing water containing 1.2 mg/l of calcium ion and 0.4 mg/l of magnesium ion, respectively. To the water thus-treated was added sodium dichloroisocyanulate in an amount of 20 mg/l.

| Stabilizing Solution: (both Tank and Replenisher) | |
|---|---|
| Formalin (37% (wt/vol)) | 2.0 ml |
| Polyoxyethylene-p-mononoylphenylether (average degree of polymerization = 10) | 0.3 g |
| Disodium Ethylenediaminetetraacetate | 0.05 g |
| Water to make | 1.0 liter |

-continued

| Stabilizing Solution: (both Tank and Replenisher) | |
|---|---|
| | pH 5.8 |

Drying:

The temperature of drying was 50° C.

After these samples were processed in this manner, the magenta densities under Condition B which were obtained by the exposure amount required for obtaining a magenta density of 1.5 under Condition A are shown in Table 2 below. Further, values which are obtained by subtracting the magenta fog density just after processing under Condition A from the magenta fog density after preservation of the sample processed under Condition A at 60° C. and 70% relative humidity for 2 days are also shown in Table 2.

TABLE 2

| Sample | Coupler | Additive | Density under Preservation at 40° C. and 80% RH for 14 Days before Processing | Magenta Fog Density Increased by Preservation at 60° C. and 70% RH for 2 Days after Processing |
|---|---|---|---|---|
| (Comparison) | | | | |
| 201 | M-2 | — | 1.36 | 0.03 |
| 202 | M-44 | — | 1.35 | 0.03 |
| 203 | M-25 | — | 1.31 | 0.04 |
| 204 | M-2 | A-2 | 1.47 | 0.00 |
| (Present Invention) | | | | |
| 205 | M-44 | " | 1.47 | 0.01 |
| 206 | M-25 | " | 1.46 | 0.01 |
| 207 | M-2 | A-5 | 1.46 | 0.00 |
| 208 | M-44 | " | 1.46 | 0.00 |
| 209 | M-25 | " | 1.46 | 0.01 |
| 210 | M-2 | A-18 | 1.46 | 0.00 |
| 211 | M-44 | " | 1.46 | 0.00 |
| 212 | M-25 | " | 1.45 | 0.01 |
| 213 | M-2 | A-23 | 1.47 | 0.00 |
| 214 | M-44 | " | 1.47 | 0.00 |
| 215 | M-25 | " | 1.46 | 0.00 |

From the results shown in Table 2, it is apparent that the samples according to the present invention exhibit very small deterioration in photographic property during preservation before processing, and also exhibit very small changes in density during preservation after processing.

The chemical structures or chemical names of the compounds employed for preparing the samples as described in Examples 1 and 2 are shown below.

U-1

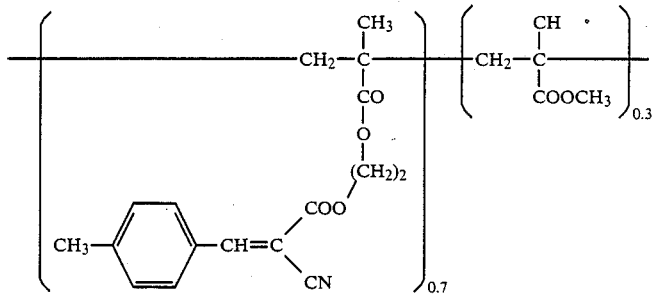

U-2

-continued
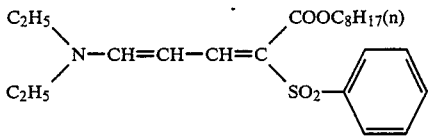
EX-1
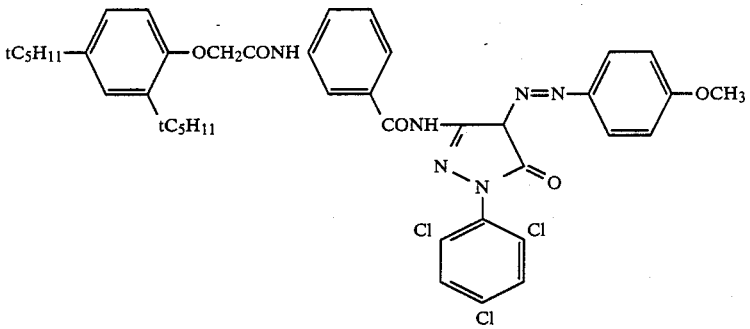
EX-2
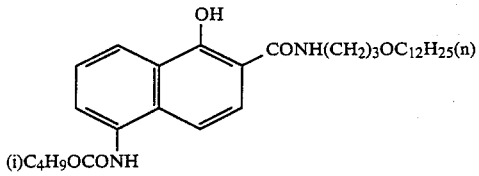
EX-3
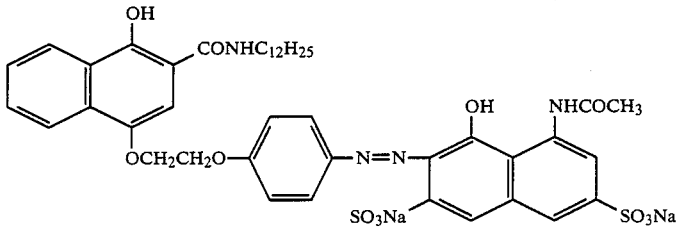
EX-4
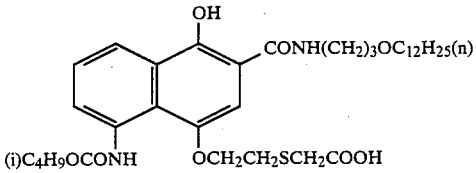
EX-5
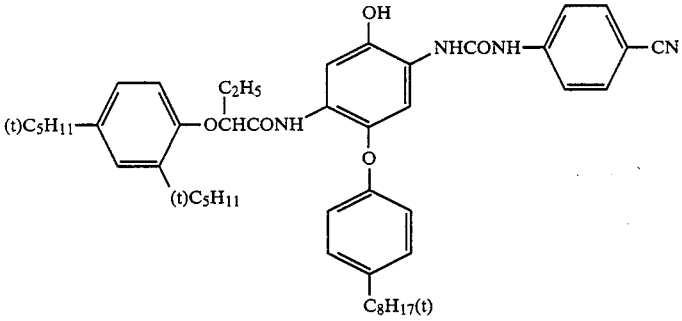
EX-6

-continued
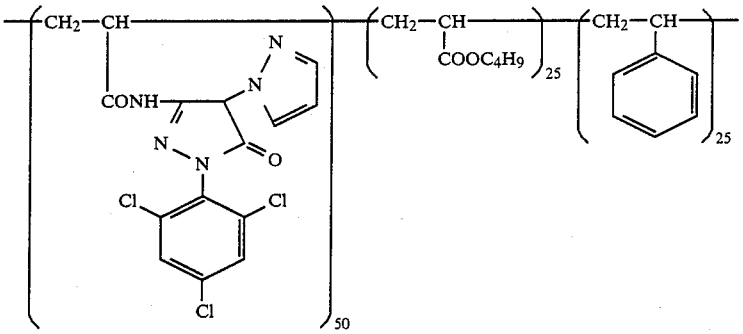
Average Molecular Weight: 30,000
EX-7
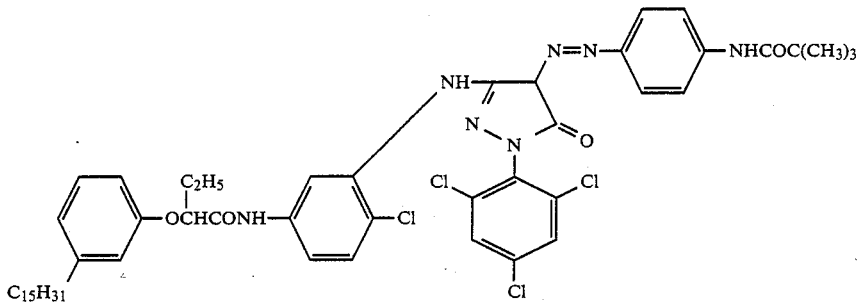
EX-8
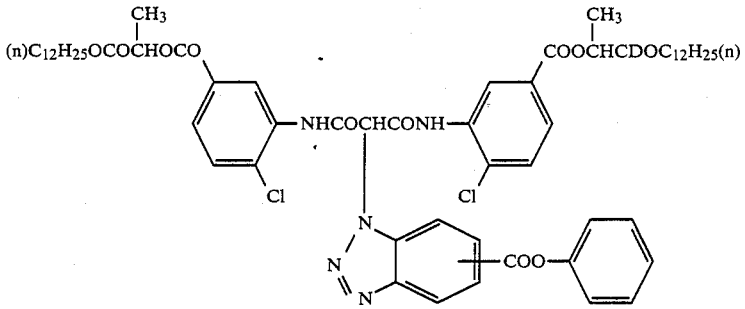
EX-9
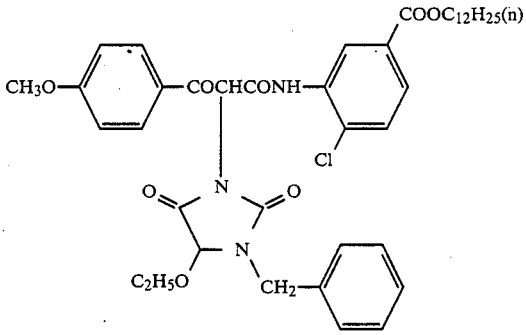
EX-10

-continued
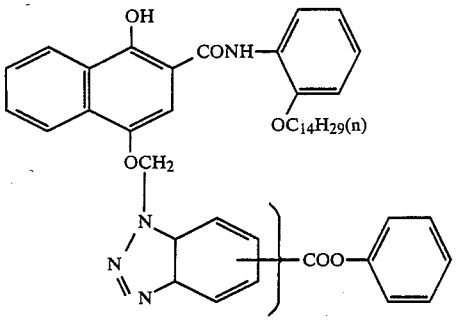
EX-11
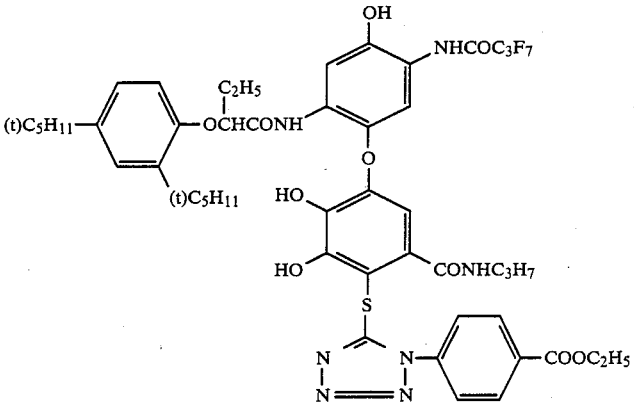
EX-12
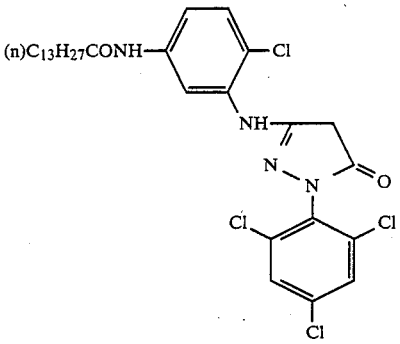
S-1
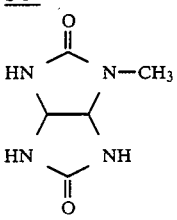
S-2
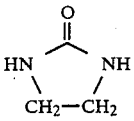
HBS-1
Tricresyl Phosphate
HBS-2
Dibutyl Phthalate
HBS-3

-continued
Tri-n-hexyl Phosphate
H-2
$$\begin{array}{l} CH_2{=}CH{-}SO_2{-}CH_2CONH{-}CH_2 \\ \qquad\qquad\qquad\qquad\qquad\qquad\qquad\quad | \\ CH_2{=}CH{-}SO_2{-}CH_2{-}CONH{-}CH_2 \end{array}$$
H-1
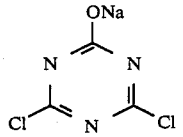
Sensitizing Dye I
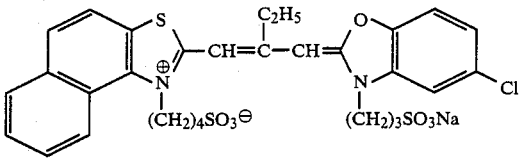
Sensitizing Dye II
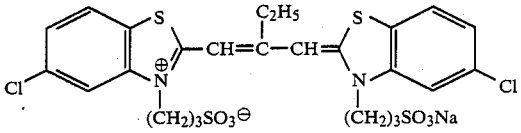
Sensitizing Dye III
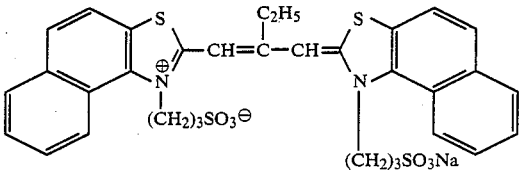
Sensitizing Dye IV
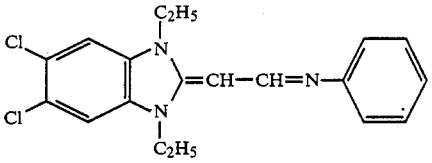
Sensitizing Dye V
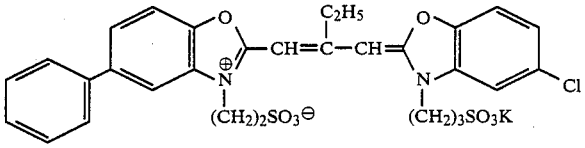
Sensitizing Dye VI
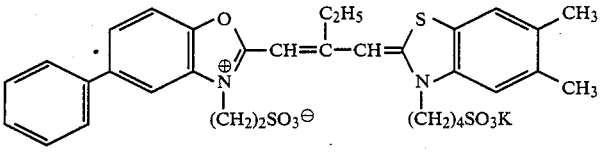
Sensitizing Dye VII -continued

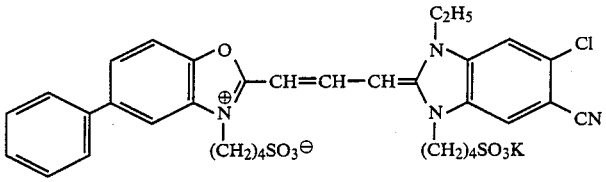

Sensitizing Dye VIII

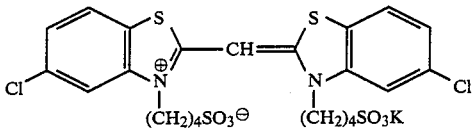

Sensitizing Dye IX

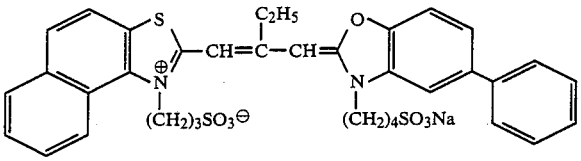

While the invention has been described in detail and with reference to specific embodiments thereof, it will be apparent to one skilled in the art that various changes and modifications can be made therein without departing from the spirit and scope thereof.

What is claimed is:

1. A light-sensitive silver halide color photographic material comprising a support having coated thereon at least one silver halide emulsion layer, wherein the silver halide color photographic material comprises at least one layer containing a 5-pyrazolone magenta coupler represented by general formula (I) and a non-color forming, diffusion-resistant carboxylic acid compound

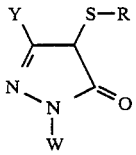

(I)

wherein W represents a substituted or unsubstituted aryl group; Y represents a carbonamido group, a ureido group or an anilino group; and R represents an alkyl group, an aryl group or a heterocyclic group, and wherein said carboxylic acid compound is represented by the following general formula (V):

$$(R_6\text{—}COO^-)_l M^{l+}$$

(V)

wherein $R_6$ represents a diffusion-resistant substituent having from 8 to 40 total carbon atoms; $m^{l+}$ represents a hydrogen ion, a metal ion or an ammonium ion; and l represents an integer from 1 to 4.

2. A silver halide color photographic material as claimed in claim 1, wherein a substituent for the substituted aryl group is selected from a halogen atom, a cyano group, a nitro group, a carboxy group, a sulfo group, an alkyl group, an alkoxy group, an alkoxycarbonyl group, a carbamoyl group, a sulfamoyl group, a ureido group, an alkoxycarbonylamino group, a sulfamoylamino group, a carbonamido group, and a sulfonamido group.

3. A silver halide color photographic material as claimed in claim 1, wherein Y in general formula (I) represents a carbonamido group having from 1 to 48 carbon atoms, a ureido group having from 1 to 36 carbon atoms or an anilino group having from 6 to 48 carbon atoms.

4. A silver halide color photographic material as claimed in claim 3, wherein Y is the carbonamido group or the anilino group.

5. A silver halide color photographic material as claimed in claim 1, wherein R in general formula (I) represents an alkyl group having from 1 to 36 carbon atoms, a heterocyclic group having from 1 to 36 carbon atoms or an aryl group having from 6 to 36 carbon atoms.

6. A silver halide color photographic material as claimed in claim 1, wherein the 5-pyrazolone magenta coupler is represented by the following general formula (II):

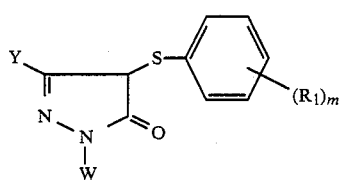

(II)

wherein W and Y each has the same meaning as defined in general formula (I); $R_1$ represents a hydrogen atom, a halogen atom, a carbonamido group, a sulfonamido group, a carbamoyl group, a sulfamoyl group, an alkylthio group, an alkoxycarbonyl group, a hydroxyl group, an alkyl group, an alkoxy group or an aryl group; and m represents an integer of from 1 to 5, and when m is 2 or more, $R_1$'s may be the same or different.

7. A silver halide color photographic material as claimed in claim 6, wherein the 5-pyrazolone magenta coupler is represented by the following general formula (III):

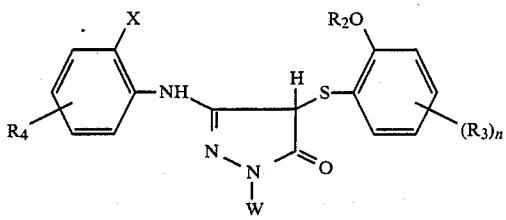

(III)

wherein W has the same meaning as defined in general formula (II); $R_2$ represents an alkyl group or an aryl group; X represents a halogen atom or an alkoxy group; $R_3$ represents a hydrogen atom, a hydroxyl group, a halogen atom, an alkyl group, an alkoxy group or an aryl group; $R_4$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxyl group, or a trichloromethyl group; and n represents an integer of from 1 to 4.

8. A silver halide color photographic material as claimed in claim 7, wherein the total number of carbon atoms of the groups represented by $R_2$ and $R_3$ is not less than 6.

9. A silver halide color photographic material as claimed in claim 1, wherein the 5-pyrazolone magenta coupler represented by the general formula (1) is a polymer coupler formed by linking two or more couplers represented by general formula (I) with each other through a divalent group or a group having a higher valency at the substituent represented by W, Y or R, respectively.

10. A silver halide color photographic material as claimed in claim 9, wherein the polymer coupler contains a magenta color forming repeating unit represented by the following general formula (IV):

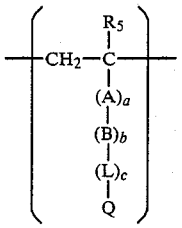

(IV)

wherein $R_5$ represents a hydrogen atom, an alkyl group having from 1 to 4 carbon atoms or a chlorine atom; A represents —CONH—, —COO— or a substituted or unsubstituted phenylene group; B represents a substituted or unsubstituted alkylene group, a substituted or unsubstituted phenylene group or a substituted or unsubstituted aralkylene group; L represents —CONH—, —NHCONH—, —NHCOO—, —NHCO—, —OCONH—, —NH—, —COO—, —OCO—, —CO—, —O—, —S—, $—SO_2—$, $—NHSO_2—$ or $—SO_2NH—$; a, b and c each represent 0 or 1; and Q represents a magenta coupler residue which is formed by removing a hydrogen atom from the W, Y or R substituents in the compound represented by general formula (I).

11. A silver halide color photographic material as claimed in claim 10, wherein the polymer coupler comprises a magenta color forming monomer capable of providing a coupler unit represented by general formula (IV) and a non-color forming ethylenic monomer.

12. A silver halide color photographic material as claimed in claim 11, wherein the non-color forming ethylenic monomer is selected from an acrylic acid, an ester of an acrylic acid, an amide of an acrylic acid, a vinyl ester, an acrylonitrile, an aromatic vinyl compound, itaconic acid, citraconic acid, crotonic acid, vinylidene chloride, a vinyl alkyl ether, an ester of maleic acid, N-vinyl-2-pyrrolidone, and 2- or 4-vinyl pyridine.

13. A silver halide color photographic material as claimed in claim 1, wherein the substituent represented by $R_6$ is selected from a straight chain or branched chain alkyl group, an alkenyl group, a cycloalkyl group, an alkynyl group, an aralkyl group, a cycloalkenyl group, an aryl group or heterocyclic group, and each of these groups may be substituted.

14. A silver halide color photographic material as claimed in claim 1, wherein the ammonium ion represented by $M^{l+}$ is represented by the following formula:

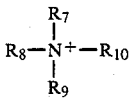

wherein $R_7$, $R_8$, $R_9$ and $R_{10}$, which may be the same or different, each represents a hydrogen atom, an alkyl group which may be substituted, an aralkyl group which may be substituted, or an aryl group which may be substituted; the total number of carbon atoms included in $R_7$, $R_8$, $R_9$ and $R_{10}$ being up to 20; and any each two of $R_7$ to $R_{10}$ may be connected with each other to form a ring.

15. A silver halide color photographic material as claimed in claim 14, wherein a substituent for the alkyl group, aralkyl group and aryl group is selected from a nitro group, a hydroxy group, a cyano group, a sulfo group, an alkoxy group, an aryloxy group, an acyloxy group, a carbonamido group, a sulfonamido group, a sulfamoyl group, a halogen atom, a carboxy group, a carbamoyl group, an alkoxycarbonyl group and a sulfonyl group.

16. A silver halide color photographic material as claimed in claim 1, wherein said carboxylic acid compound is present in an amount of from about 0.01 to about 100 times by weight based on the 5-pyrazolone magenta coupler present in the same layer.

17. A silver halide color photographic material as claimed in claim 1, wherein the layer containing the 5-pyrazolone magenta coupler and the carboxylic acid compound is a green-sensitive silver halide emulsion layer.

18. A silver halide color photographic material as claimed in claim 17, wherein the color photographic material further comprises at least one blue-sensitive silver halide emulsion layer and at least one red-sensitive silver halide emulsion layer.

19. A silver halide color photographic material as claimed in claim 18, wherein said at least one blue-sensitive silver halide emulsion layer contains at least one yellow color forming coupler and said at least one red-sensitive silver halide emulsion layer contains at least one cyan color forming coupler.

* * * * *